United States Patent [19]

Brouwer et al.

[11] Patent Number: 4,466,468

[45] Date of Patent: Aug. 21, 1984

[54] STRAND DELIVERY SYSTEM

[75] Inventors: Charles W. Brouwer, East Greenwich; Larry C. Cowan, Saunderstown; Robert Horton, Warwick; Karl W. Wueger, Wakefield, all of R.I.

[73] Assignee: Leesona Corporation, Warwick, R.I.

[21] Appl. No.: 64,395

[22] Filed: Aug. 6, 1979

[51] Int. Cl.[3] ..... D03D 47/30

[52] U.S. Cl. ..... 139/435

[58] Field of Search ..... 139/435; 239/407, 409, 239/410; 226/7, 97

[56] References Cited

U.S. PATENT DOCUMENTS

| | | | |
|---|---|---|---|
| 3,465,939 | 9/1969 | Mullelcom | 139/435 |
| 3,782,422 | 1/1974 | Vermeulen | 139/435 |
| 3,905,402 | 9/1975 | Jansa et al. | 139/435 |
| 4,105,053 | 8/1978 | Fajfr | 139/435 |

*Primary Examiner*—Henry Jaudon

*Attorney, Agent, or Firm*—Burnett W. Norton

[57] ABSTRACT

An intermittently-operating strand delivery system having:

(1) a nozzle passageway through which the strand is guided;

(2) a supply for pressurized medium;

(3) conduit means connecting between said nozzle passageway and said supply including a pressure-operated on-off flow valve; and (4) separate servo valve units for independently applying and releasing control pressure, respectively to and from the pressure-operated flow valve to move the cam between alternately open and closed positions to admit medium from the supply to the nozzle passageway for a controlled interval and thereby permit a pulse of medium to pass through the nozzle passageway and project a length of the weft strand therefrom. The servo units can take the form of separate solenoids or rotary spool valves. The opening of the pressure-operated valve preferably incorporates an avalanching effect to accelerate its opening action.

33 Claims, 26 Drawing Figures

FEED AIR
CONTROL AIR
MAIN AIR
139
145
143
77
81
173
163
165
167
161
115
149
147
116
151
101
153
95
89
85
75
127

FIG. 15.
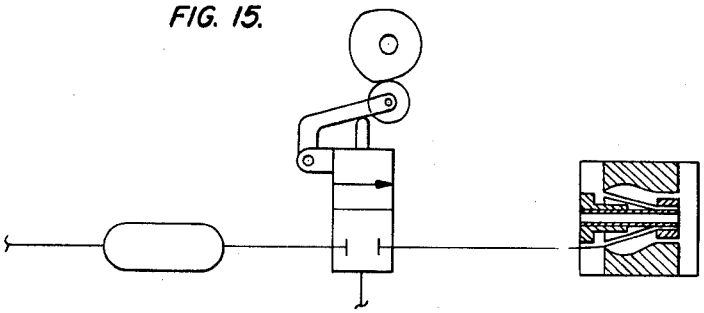
FIG. 6.
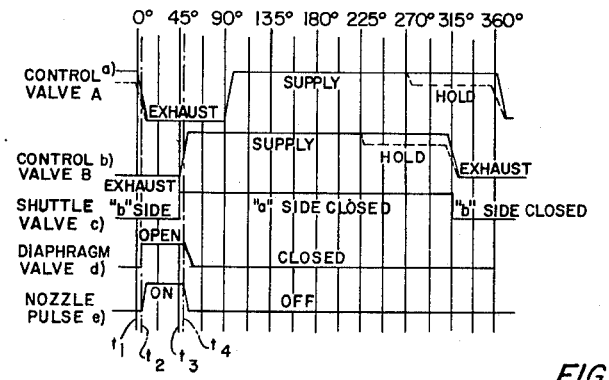
FIG. 11.
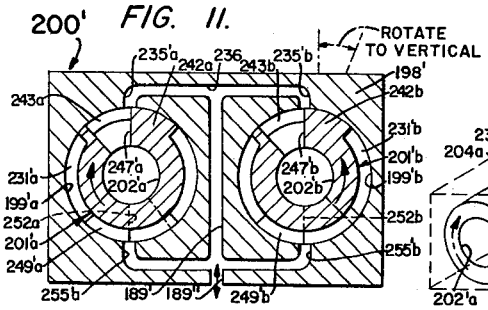
FIG. 10.
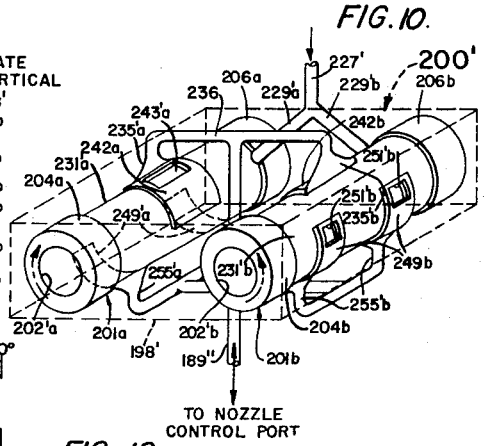
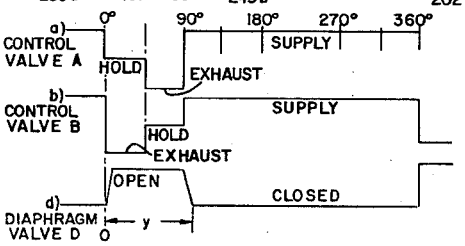
FIG. 12.

STRAND DELIVERY SYSTEM

FIELD OF THE INVENTION

This invention relates to a loom weaving system in which the weft is inserted through the shed of the loom by means of a pulse-like jet of air or other pressurized gaseous medium (hereinafter referred to generally as an air weft insertion system) and is concerned more particularly with an efficiently operating air weft insertion system capable of substantially increasing the insertion velocity of the air jet through the loom shed compared to existing systems with a corresponding reduction in actual weft insertion times to adapt the system for high speed weaving.

BACKGROUND OF THE INVENTION AND PRIOR PRACTICE

In all weaving, an initially flat array of longitudinally extending warp threads is divided into at least two interspersed groups which are separated in opposite directions from the starting plane to define between the separated warp groups an elongated diamond shaped space, known as a "shed", through which the weft or filling is inserted, the direction of separation of the warp groups being reversed in a given order after each such weft by means of a harness motion with the result that the warp threads are entwined in sinuous fashion around successive filling threads to form the woven fabric. Traditionally, the weft is carried in coiled form upon a bobbin held within a shuttle, and as the weaving progresses, the shuttle is propelled alternatively back and forth through the shed on the upper surface of a beam-like lay which carries a comb-like reed projecting upwardly therefrom and rocks back and forth to press or "beat up" each new weft by means of the reed against the working end or "fell" of the fabric being woven. In the traditional loom, bobbin propulsion was accomplished by means of so-called picker sticks mounted on the loom adjacent opposite side edges of the warp for pivotal movement about their lower ends and driven to alternately impact their upper ends against the shuttle. Obviously, this conventional design was subject to inherent limitations as to achievable shuttle speed and was, moreover, accompanied by substantial disadvantages; namely, deafening operating noise as well as risk of breakage of picker sticks or other damage to equipment and of danger to operating personnel when, as occasionally happened, the shuttle escaped its containment and became an uncontrolled projectile. In order to overcome these inherent problems in bobbin type weaving, the prior art has explored various alternatives, and in the past decade or so, increasing attention has been directed to the possibility of impelling the weft thread through the shed by means of a jet of fluid. Jets of water have been found to be a relatively manageable projection medium, but water is a possible cause of corrosion and limits the choice of yarn material; thus there are significant advantages in the use of a gaseous fluid. While gases other than air can in theory serve equally well, cost considerations dictate the choice of air as the only practical gaseous propelling medium; consequently, this mode of weaving will hereinafter be referred to for convenience as "air weft insertion", although the use instead of other gases is, in principle, intended to be included.

In general, air projection techniques that have been used in past air weft insertion systems fall into two basic categories. In one type, the weft end is initially projected by means of a pressurized air from a nozzle situated outside and adjacent one side of the warp shed which serves to initially accelerate the weft end and starts its travel through the shed. The propulsion forces of existing nozzles is severely limited in terms of the attainable length of projection of the weft end and hence, in this type, a plurality of "booster" or supplemental jet nozzles is provided at spaced intervals through the shed, such nozzles being inserted within and removed in various ways from the shed interior via the clearance between the warp yarns. The aggregate of the propulsion forces of this multi-stage sequence of nozzles can be sufficient to convey the weft thread across the full width of the loom.

While this approach has proved generally feasible in practice, it too is faced with definite disadvantages, viz, the requirement for carefully controlled timing of the sequence of nozzle action plus excessive consumption of compressed air and thus poor economic efficiency.

In order to avoid the need for booster nozzles disposed at intervals through the shed, an alternative approach has been developed in a second type which utilizes a single exterior insertion nozzle in conjunction with a weft guidance "tube" situated within the shed. Since during weaving, the groups of warp threads must shift up and down past one another, the presence of any continuous body within the shed during shedding is out of the question. Therefore, an "interrupted" weft guidance tube is used, taking the form of a plurality of generally annular segments, each shaped to sufficiently narrow thickness in its axial dimension as to pass between adjacent warp threads arranged in an axially aligned position so as to constitute together a lengthwise interrupted tubular member extending substantially the entirety of the shed width. Each annular segment has a slot-like exit opening at a point on its periphery to allow lateral egress of the inserted weft thread when the guidance tube is withdrawn below the shed. When the weft thread is projected by the exterior nozzle into one end of this interrupted guidance tube, the projection force imparted to the thread by the nozzle appears to be substantially enhanced so that the distance the weft thread is propelled by this force can be significantly increased compared to the nozzle alone.

Irrespective of whether the propulsive force of the insertion nozzle is assisted by means of in-shed booster nozzles or an interrupted guidance tube, the control of the flow of the pressurized medium to the injection nozzle presents a certain mechanical problem, due to the inherent characteristics of available flow control valves. In the past, these problems have not been particularly serious because the flow of the insertion medium through the nozzle was maintained for a substantial period of time, relative to the operating cycle of the loom, and it was readily possible to design valve instrumentation that would operate within this relatively broad time frame. However, it can become advantageous from the standpoint of reducing the maximum duration of the operating cycle of the loom so as to achieve a consequential increase in the production speed of the loom to reduce the duration of the flow of the insertion medium through the nozzle; and as the weft insertion time becomes less and less, a limit is reached at which the control of the flow valves becomes quite critical.

In general, the flow valves determining the flow of the insertion medium through the insertion nozzle move between a substantially fully open and a substantially fully closed position so that the insertion medium is either fully admitted to the nozzle or else shut off therefrom, although the extent of the open position may, of course, be adjustable to vary the pressure and quantity of the medium being delivered. Any valve operating in this way has a certain inherent "time constant", i.e. the period of time required for the movable part of the valve to move through an entire cycle of operation and even when the valves are of the electrically actuated solenoid type, and thus free of the inertial and impedance lags of mechanical or pneumatic actuating devices, the time constant of the valve will be a significant value in terms of milliseconds of operating time and as a usual rule, one stage of the valve operating cycle, ordinarily the return phase tends to be considerably longer than the other stage. Consequently, while it might be possible to move the valve, say to open position, in a relatively brief period, the valve must obviously be returned to closed position before it can again be moved to open position and the lag of the solenoid in being restored to starting position constitutes a substantial limit on the practical operating frequency possible with such a valve.

SUMMARY OF THE INVENTION

In accordance with the present invention, a pressure operated off-on flow valve, preferably having the form of a diaphragm exposed to a control pressure on one of its faces and movable in response to application and release of such pressure between a position shutting off the flow of insertion medium to a weft insertion nozzle and a position permitting such flow, is controlled by means of two separate and independent servo valves which are capable of independently applying and releasing control pressure respectively to and from the pressure operated valve. With such an arrangement, the operating frequency of the flow valve becomes independent of the time constant of the servo valves so as to permit the flow valve to complete a full cycle of operation within a minimal period of time.

STATEMENT OF OBJECTS

An object of the invention is an actuation control unit for an improved weft insertion nozzle which can either be electrically or mechanically activated and makes possible accelerated and precisely reproducible response times in the firing of the nozzle.

Another object of the invention is an improved flow control system for the insertion medium in which the flow of the medium to the insertion nozzle is determined by means of a pressure operated off-on flow valve and separate servo valves independently control the application and release of the control pressure to the flow valve.

BRIEF DESCRIPTION OF DRAWINGS

These and other objects and advantages will be more fully explained by the following complete description when read in conjunction with the accompanying drawings in which:

FIG. 6 is a wave form diagram illustrating the operation of the control unit of FIG. 5;

FIG. 10 is a side perspective view of a modified mechanically operating air control unit for the insertion nozzle of the invention with the housing shown only in outline and the air conduits appearing schematically as conduits;

FIG. 11 is a vertical section somewhat diagrammatic through the modified mechanical control unit of FIG. 10 and including the housing;

FIG. 12 is a wave form diagram illustrating the operation of the mechanical control unit of FIGS. 10 and 11;

FIG. 15 is a schematic view indicating diagrammatically an arrangement for simulating a prior art air weft insertion system;

FIG. 25A is a recreation in terms of head pressure versus time on a still different scale of a pressure trace generated by the preferred nozzle in the system of the invention equipped with an added supply capacity or accumulator; while

GENERAL DESCRIPTION OF SYSTEM OF INVENTION

The strand delivery system of the present invention is preferably utilized in the context of an overall loom which is described in general terms in the following summary. For further details as to the specific features which are embodied in the loom reference may be had to U.S. Pat. No. 4,347,872, issued Sept. 7, 1982, the subject matter of which not contained in this disclosure being herewith incorporated by reference.

Figure 1:
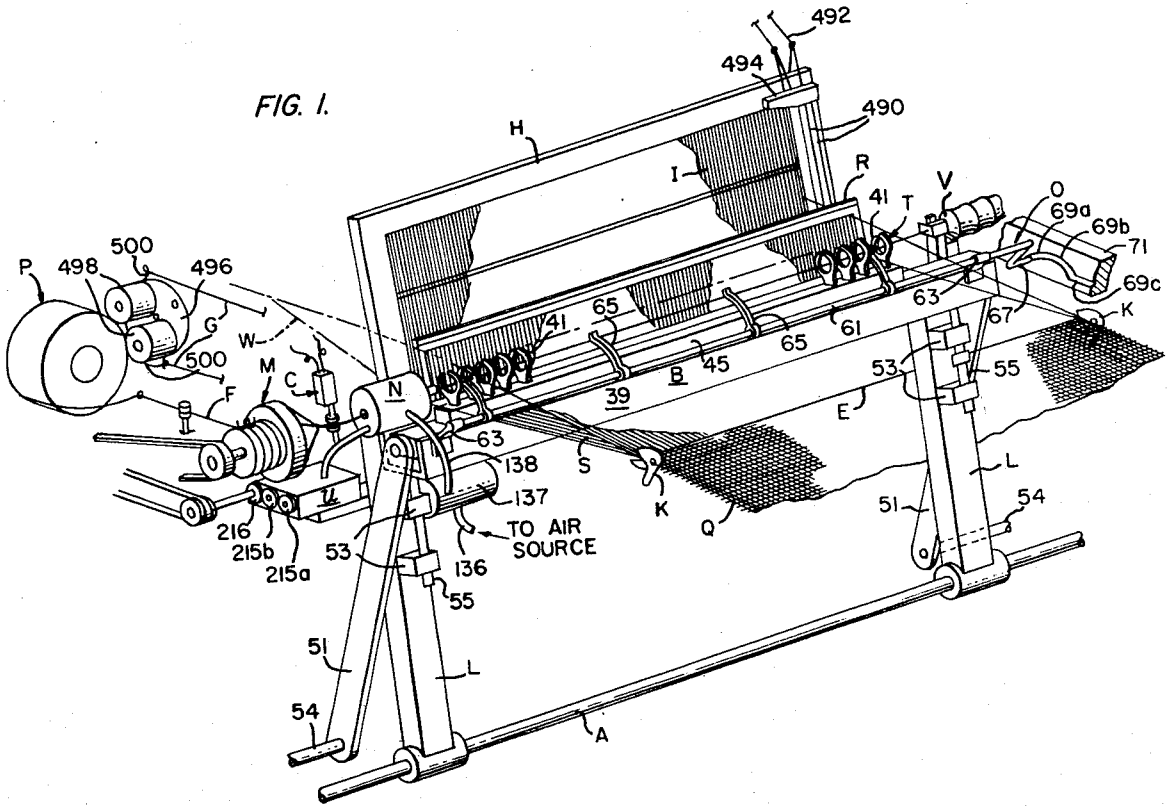
FIG. 1 is a highly schematic view in perspective of the essential components of a loom incorporating the present invention.
Figure 2A:
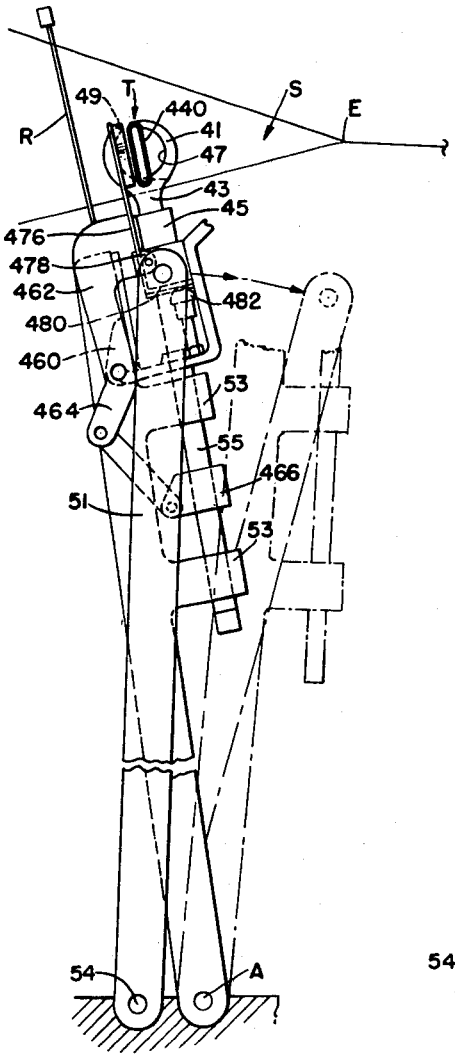
FIGS. 2A and 2B are enclarged detail views looking at the left end of the lay of the loom of FIG. 1 in rearward weft inserting position and forward beat up position, respectively, showing the compound motion of the weft guidance tube.
Figure 2B:
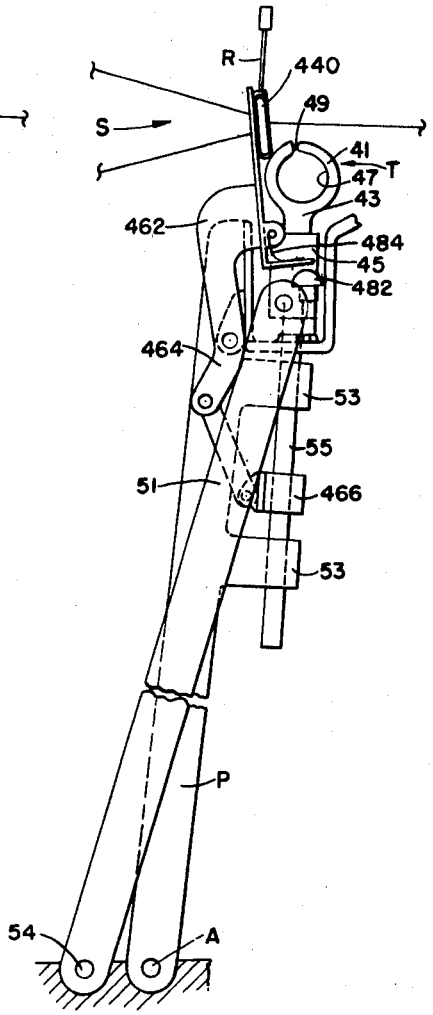

The loom of the present invention is basically conventional in much of its construction and operation (with one adaptation to better suit the requirements here), and the loom structure is illustrated schematically in an overall view in FIG. 1 and described generally with alphabetical designation only in enough detail to establish the context of the present improvements. As usual, the warp threads on ends W are carried on a rotatably supported warp beam (not seen) and pass therefrom through the eyes of parallel arrays of heddle wires I arranged in two or more separate groups held in adjacent parallel planes by corresponding heddle frames H. The heddle frames H are mounted for alternating up and down reciprocation whereby the groups of warp threads are separated to form an elongated diamond-shaped shed S having its front corner defined by the fell E of the fabric being woven. Forwardly of the heddle frames H, a lay beam B extends withwise across and beneath the lower plane of the warp, the lay beam B being mounted at its ends on generally upstanding supports or swords L which are pivoted on a shaft A at their lower ends and are rocked to and fro by driving means, such as a crankshaft, not shown. A reed R in the form of a sheet-like array of wires on the flat plates with the warp threads passing in the clearance space therebetween projects upwardly from the rear side of the lay to impress each new weft against the fell as the lay rocks forwardly. The woven fabric is collected in a conventional way upon a take-up beam, not shown.

The fabric has a rough or fringe selvage Q because the weft is inserted in the warp shed continuously from the same side of the warp shed rather than alternately from opposite sides as in conventional shuttle weaving. This rough selvage may be trimmed by means of trimming shears or knives K in operative position at the fell line and actuated in the usual way.

In accordance with the invention, the lay B of the loom is equipped with an interrupted segmental weft guidance tube to facilitate in a manner known in itself the delivery of weft or filling strands F through the shed, the guidance tube obtruding in interdigitating fashion with the warp ends into the interior of the shed when the lay is in its rearmost position and withdrawing from the shed while the lay moves forward. The lay preferably carries a weft lift-out device generally designated O to positively displace the inserted weft F from the guidance tube. The weft is projected into the interrupted guidance tube by means of a burst or pulse of air emitted by a weft insertion nozzle N mounted on the lay adjacent one side of the shed, while the free end of the inserted weft is received beyond the far side of the shed within a vacuum reception tube V carried on the opposite end of the lay and if desired is engaged by a clamp (not seen in FIG. 1) associated with that tube. Preferably, the tube is displaceably supported to follow the path of the weft during beat up. The reception tube can include photoelectric detection means (not seen) to detect the arrival of the weft thereat and initiate a control signal in the absence of the weft. The generation of the pulse or burst of air through the nozzle is precisely controlled by means of a nozzle activation control unit U which is actuated in timed relation to the cyclical operation of the loom. A proper length of weft is withdrawn from a weft package or oher source P and made available to the insertion nozzle N by means of a strand metering and delivering unit M disposed at a fixed position outboard of the insertion nozzle N, and a clamping means C is interposed between the metering unit M and nozzle N for positively gripping the weft F in timed relation to the inserting action.

DETAILED DESCRIPTION OF INVENTION

I. Apparatus a. Weft Insertion Nozzle Assembly

Figure 3:
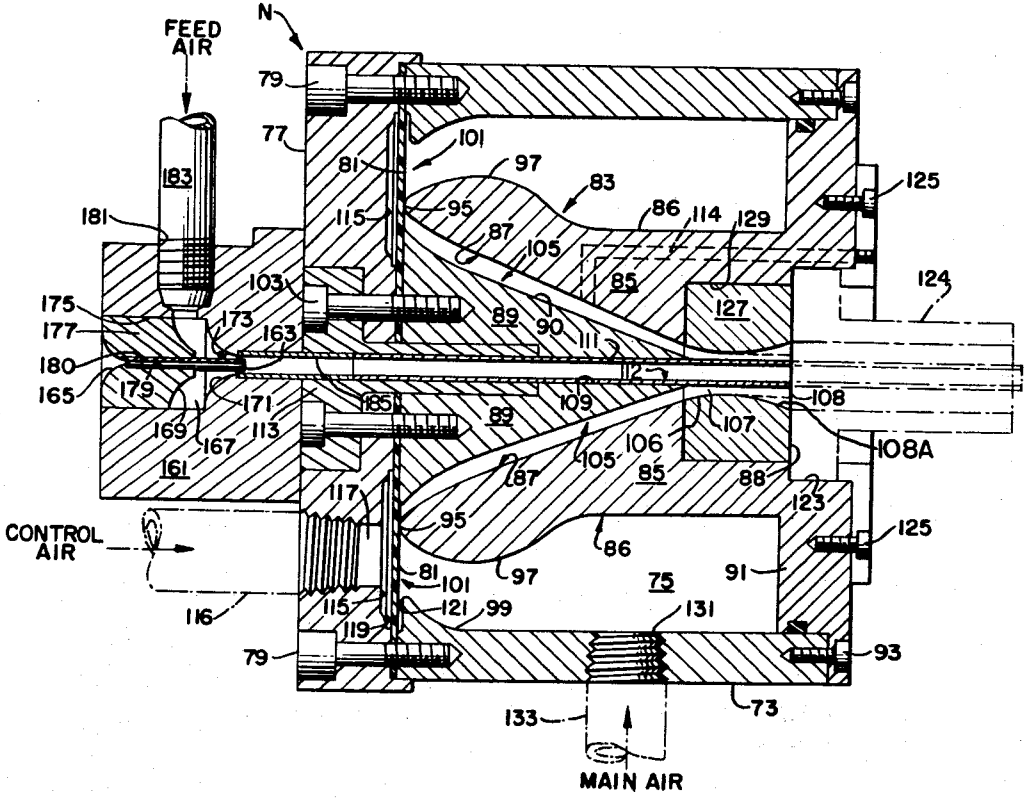
FIG. 3 is an enlarged detailed view of one embodiment of weft insertion nozzle according to the invention taken in cross-section through the nozzle axis.

In order to achieve more precise and instantaneous control over the flow of air from nozzle N for propelling the weft strand across the warp shed of the loom, a special nozzle and servo control assembly has been devised. As shown in FIG. 3, this nozzle assembly has an exterior casing 73 enclosing an interior space, the casing being preferably circular in shape, although its configuration is not critical. One end of the casing, at the left in FIG. 3, is sealed by a cover plate 77 securd via bolts or other securing means 79, a flexible diaphragm 81 being tightly clamped around its margins between the abutting surfaces of the casing and the plate and spanning the casing end. Within the interior of the casing is a two-part core generally designated 83 having the dual function of delineating with the interior wall of the casing an axially elongated annular storage chamber 75 for containing a determined amount of compressed air and forming between its two parts an annular divergent passageway ending in a throat and exit opening.

The two parts of the core including an outer hollow sleeve 85 having a generally cylindrical outer wall 86 and a conical inner bore 87 and an internal generally flaring trumpetshaped plug 89 fitting in spaced relation within the conical bore of the sleeve. The hollow sleeve 85 can be means of an integral peripheral flange 91 at its outer (right) end 88 be affixed with screws or the like 93 to the other end of the casing, to complete the enclosure of the storage chamber space, although the sleeve and flange could be formed separately and connected together. In any event, sleeve 85 is supported in cantileverlike fashion within casing 73 by a connection of its outer end to the right of the casing which also seals that casing and (except for the nozzle orifice), the inner end of the sleeve projecting free within the casing to adjacent its head end.

The free end edge of the hollow sleeve 85 is rounded as at 95 so as to give a smooth nearly re-entrant curvature between the adjacent margins of the conical wall 87 and the outer wall 86 of sleeve 85. Preferably, the section of outer wall 86 adjacent free end edge 95 is developed with a convex or somewhat bulbous curvature as at 97 to merge more smoothly with the rounded free end edge 95, while the corresponding section of the interior wall of casing 73 projects radially inwardly along a concave curvature as at 99 to form therebetween a gradually tapering inwardly curving annular mouth 101 at the end of storage chamber 75.

The rounded free end edge 95 of sleeve 85 makes abutting contact with an inner annular region of the diaphragm 81 and functions as the seat of a "valve" which acts, as will be explained, to control the flow of pressurized air from storage chamber 75. The interior wall 87 of the core sleeve, after a slight initial convex curvature at its end merging with the rounded free end edge 95, has a generally uniform conical inclination and within this conical space the trumpet-shaped plug 89 is held in fixed depending relation from the inner side of casing head 77 by means of fastening bolts 103 or the like, the center region of the diaphragm being pinched between the flat end face of the plug and the casing head. The outer wall 90 of the plug is spaced from the conical inner wall 87 of sleeve 85 and together define a converging annular supply passageway 105 which gradually decreases in radius toward the supported sleeve end 91 and undergoes a slight narrowing in annular thickness adjacent the rounded end edge 95 of the sleeve.

The apex end of trumpet-shaped plug 89 terminates somewhat short of the outer end of conical bore 87 of sleeve 85 and the remainder of bore 87 converges as at 106 to a throat region 107 of the nozzle connecting with the tapering annular passageway 105. Throat region 107 extends to an orifice opening 108 in the supported end of sleeve 85 either in straight cylindrical fashion as shown in dotted lines at 108 in FIG. 3, or in flaring divergent fashion as at 108*a*, as indicated in solid lines, depending upon the type of nozzle orifice opening that is desired, as will be explained.

Passing through the interior of trumpet-shaped plug 89, and preferably in coaxial relation thereto, is a small axial passage 109 which is occupied by a weft feed tube 111 extending the entire length of plug 89 and projecting therebeyond at least to the plane of the outer end face 88 of sleeve 85 and thus the outer limit of the bore 107 therein. Preferably, the strand feed tube 111 is constructed integrally with a T-shaped carrier spindle 113 embedded in the plug and fastened thereto, for instance with the same bolts 103 securing plug 89 itself to casing head 77. The feed tube and carrier spindle make a sliding telescoping fit with the axial passage 109 in the plug to facilitate ready removal of the tube for cleaning or replacement.

Figure 4:
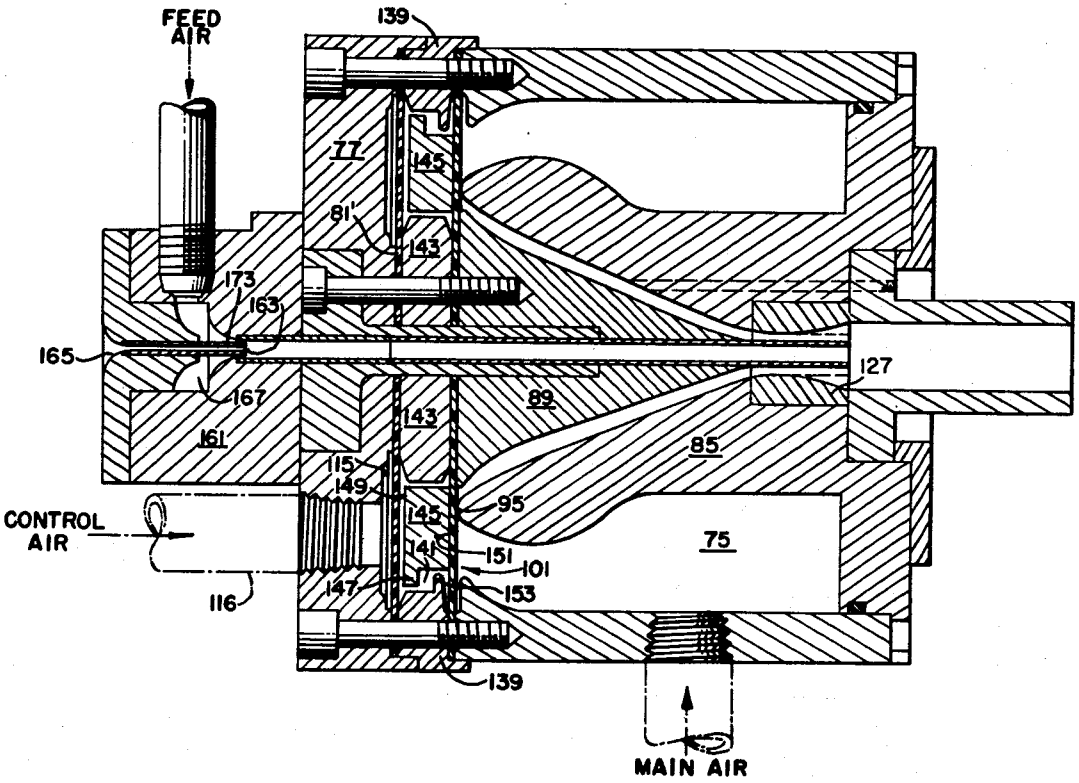
FIG. 4 is a cross-sectional view similar to FIG. 3 of a modified embodiment of weft insertion nozzle.

The interior face of casing head 77 facing diaphragm 81 opposite chamber 75 is relieved to define a shallow annular recess or manifold 115 opening toward and, in effect, closed by the diaphragm and this annular recess is connected by a line 116, shown in dotted lines in FIG. 4, through a suitable port 117 in the casing head to a source of a gaseous control medium, e.g., air (not shown) for the purpose of controlling the movement of the diaphragm. It will be understood that diaphragm 81 is exposed on its interior face to an annular area of predetermined dimension formed by the shallow manifold 115 in the casing head. Because the diaphragm will flex as required to balance the forces acting on its two faces, its movement will be determined by the ratio of each of these areas multiplied by the corresponding pressure of the media acting thereon. The annular areas of mouth 101 and manifold 115 can be the same; in that event, so long as the pressure of the control air in manifold 115 is less than the effective pressure of the air in storage chamber 75, the diaphragm 81 will be displaced upwardly away from the rounded end edge 95 of the core sleeve, establishing communication between mouth 101 of chamber 75 and the beginning end of the annular passageway 105 to the nozzle orifice opening 108.

Since annular passageway 105 begins on the radially inward side of the rounded end edge 95 of sleeve 85 proximate the chamber mouth 101, it will be seen that the instant diaphragm 81 starts to leave its seat on the rounded end edge and pressurized air begins to escape from the storage chamber mouth 101, the effective annular surface area of the diaphragm exposed to chamber pressure increases or "grows", which acts to further unbalance the forces acting to flex the diaphragm away from its seat in a kind of avalanching effect. Consequently, the diaphragm moves virtually instantaneously from its seated closed position to the limits of its unseated or open position, as allowed by its operating characteristics, i.e. its flexibility, tension clearance, etc. Thus, the opening action of the diaphragm "valve" of the nozzle of the invention is extremely rapid and, indeed, it has been found possible to achieve an operating response for the design in the order of one ms, in terms of the time required for the pressure in the annular passageway 105 to reach essentially the full pressure existing initially in storage chamber 75.

When it is desired to terminate the flow of air from storage chamber 75, a control air pressure of sufficient magnitude is reimposed on the exterior side of the diaphragm within the annular control manifold 115 and, it will be realized that if the effective inner and outer annular diaphragm surface areas are the same, a control pressure in excess of the storage chamber pressure will be required to restore the diaphragm to its seated position in contact with the rounded end edge 95 of the core sleeve. For this reason, the ratio of the annular or radial dimension of the control manifold 115 to the annular or radial dimension of the mouth 101 of the storage chamber is preferably substantially greater than 1, e.g. in the order of 2 or more to 1, to reduce the difference between closing and opening control pressure. The selection of such higher ratios of effective surface areas has the further advantage of allowing a control pressure to be derived from the same source as the supply to the storage chamber 75, recalling that the control pressure itself need not be greater than storage chamber pressure, due to the "multiplier effect" of the unequal ratio of the effective annular areas on opposite sides of the diaphragm.

Since the air in escaping from storage chamber 75 must undergo a substantial complete reversal of direction in moving from chamber mouth 101 into annular passsageway 105 when the diaphragm valve opens, it is desirable for mouth 101 and the entrance to the passageway 105 to be contoured as already described to promote smooth transition in air flow and clean communication between mouth 101 and passageway 105 without sharp edges or angles in the walls and thereby reduce turbulence and friction losses in air flow and minimize abrasive wear upon the diaphragm, which must in operation undergo rapid oscillation between its closed and open positions. For the same reasons, the surface of the casing wall and head contiguous to the unsupported annular region of the diaphragm should be relieved slightly as at 119 and 121 so as to provide clearance space for the free oscillation of the diaphragm. Otherwise, the life of the diaphragm will be severely reduced. A suitable diaphragm material is buna or neoprene rubber preferably reinforced with fabric.

The total volume of passage 105 and throat 107 is made as small as possible consistent with other needs since the space downstream of diaphragm 81 contains residual air after the diaphragm closes and if too large prolongs the decay characteristics of the nozzle.

Under some circumstances, an extension of the nozzle orifice opening 108 in the outer face 88 of sleeve 85 by means of a straight cylindrically-shaped barrel 121 (seen in dotted lines in FIG. 3) may be useful. A central region of sleeve end face 88 can be recessed as at 123 for reception of one end of such a barrel 124 which can be secured in place by means of bolts or other fasteners 125 and construction of the core sleeve and supporting flange in two pieces may simplify the design of this assembly.

For versatility in use, it is advantageous for the size and contour of the throat area of a given nozzle assembly to be variable and for this purpose the throat region of the nozzle sleeve is constituted by an interchangeable insert 127 fitting with close tolerances into a socket 129 in the sleeve end. Each insert can be bored to a given size and contour to allow the nozzle characteristics to be easily changed. No special sealing or gasketing is needed at tolerances of $\pm 1/1000''$.

The weft insertion nozzle assembly N is mounted upon the lay of the loom so that the nozzle can be "fired" at the proper point in the operating cycle of the lay. As mentioned, the weft insertion nozzle could be mounted for a compound movement similar to that of the guidance tube. However, this "tracking" relationship is not required, and very satisfactory results have been achieved by mounting the nozzle in fixed relation upon the lay with its axis approximately in alignment with the axis of the interrupted guidance tube when the latter is in dwell position at the extreme rearward point of the lay motion.

Utilization of the diaphragm control "valve" just described, eliminates the need for additional control valves in the supply of the pressurized air to the storage chamber and the casing wall can have a supply port 131 connected to an end of a supply conduit 133 (in dotted lines) running to the main supply source not shown. A preferred embodiment of a complete circuit of the pressurized medium will be described later.

Because of the desirability for the nozzle to be mounted bodily upon the lay, the overall size of the nozzle is preferably kept within fairly modest proportions to avoid interference with other parts of the loom, and this in turn imposes a limitation upon the permissible capacity of the storage chamber 75 within the nozzle. In the design shown, an acceptable capacity for the storage space has been found to be 6 in $^3$. With this limited capacity, the pressure that develops within passageway 105 upon opening of the diaphragm valve may undergo early decay from a maximum or peak value equal to the storage pressure within storage chamber 75, and this decay in driving pressure can result in a reduction in the effective thrusting force actually exerted upon the weft strand. In the present preferred practice of the invention, the driving pressure is sustained during the duration of the air pulse emitted from the nozzle orifice as closely as possible to its maximum level, and this objective can be accomplished by augmenting the storage chamber capacity with a supplmental reservoir or accumulator 137 of substantially greater capacity and connected to the supply pressure source as at 136. In this way, the effective head pressure delivered the nozzle orifice through passageway 105, which would otherwise decay as more and more of the air escapes from storage chamber 75, is continuously replenished by means of fresh air supplied from reservoir 137. The reservoir should be mounted as close as convenient to nozzle N, for example, below the same end of the lay as at 137 in FIG. 1, and connected to the nozzle by a line 138.

If the diaphragm were allowed to remain open a sufficiently long time, obviously, the decaying effect would occur even with the addition of the reservoir capacity but, with the limited operating times of the nozzle of the invention, it has been found that maximum operating head pressure can be sustained through the pulse with the addition of a reservoir capacity of about 80 in$^3$.

Mention has already been made of the "multiplier effect" achieved by selection of a ratio greater than 1:1 between the effective working surface areas on opposite sides of diaphragm 81. This "multiplier effect" can be enhanced by means of an alternative nozzle construction, as shown in FIG. 4, which for the most part is identical to the nozzle of FIG. 3 and is given the same reference numerals. According to this alternative construction, a casing spacer ring 139 is interposed between the head end of the casing wall and the corresponding margins of casing head 77 with the diaphragm 81 held therebetween, and an additional pilot diaphragm 81' is clamped in place on the other side of ring 139 so that a diaphragm is situated on either side of spacer ring 139 with a separation space 141 therebetween. The central regions of the two diaphragms 81 and 81' are secured in the desired spaced relationship by means of a companion spacer disc 143 clamped between the flat face of conical plug 89 and the corresponding area of casing head 77 and in turn clamping the central regions of the diaphragms. Within the annular hollow space 141 between the two diaphragms and the mutually facing side edges of the ring and disc, there is disposed a free floating ring 145 which by virtue of a laterally projecting flange 147 has a greater annular radius, and thus a greater effective surface area, on its outer side 149 than on its inner side 151, the annular dimension of the inner and smaller side 151 of floating ring 145 being enough to completely cover via intervening diaphragm 81, the mouth 101 of storage chamber 75. Thus, a smaller control pressure applied against the outer pilot diaphragm 81' will serve to control movement of the inner operative "valve" diaphragm 81 against a given storage chamber pressure, and the ratio of the differential annular areas 149, 151 of the floating ring thereto increases the "multiplier effect" exerted upon the operating diaphragm 81 as will be seen from the following mathematical analysis.

From the aforegoing general description, it will be appreciated that an equilibrium condition will exist on the two opposite sides of the operating diaphragm 81 when the product of the pressure $P_1$ times the area $A_1$ on one surface equals the product of the pressure $P_2$ times the area $A_2$ on the other surface, and if the surface areas are fixed, this equilibrium condition will become unbalanced when the pressure on either side rises above or falls below its equilibrium value. This relationship can be illustrated quantitatively by assuming a given set of dimensions for the effective working areas of the opposite sides of the diaphragm which set is in fact employed in a preferred embodiment of the invention. Thus, it is assumed that the inner diameter of the floating ring 145 is 1.5", the outer diameter of the inner face 151 of the ring is 2.363", the outer diameter on the pilot face of the ring including the lateral flange 2.523", the diameter of the circular point of contact of the rounded sleeve end edge 95 with the operating diaphragm 81 (i.e. at the "seat" of the valve) 1.625", and the pressure ($P_3$) within the storage chamber 75 is 80 lbs. The annular area on the pilot side 149 of the ring can be calculated by subtracting the area of the interior opening from the overall area of the ring on the pilot side. Since the area is equal to ($\pi D^2/4$), the overall area of the pilot side of the ring is equal to $0.785\times(2.523)^2$ or 4.999 sq.in, while the area of the ring interior equals $0.785\times(1.5)^2$ or 1.767, the difference between the two being 3.2 sq. in which is the annular area ($A_p$) of the pilot face of the ring.

The total area of the operating face of the ring equals $0.785\times(2.363)^2$ or 4.385, while the area delimited within the end edge 95 of the core sleeve equals $0.785\times(1.625)^2$ or 2.074, for a difference of 2.311 for the annular area ($A_s$) of the operating diaphragm face which receives the force of the storage pressure. In equilibrium condition, the following equation applies:

$$P_p\times A_p=P_s\times A_s$$

where $P_p$ is the unknown pilot pressure in manifold 115. Substituting the known values for $A_s$, $A_p$, and $P_s$, $P_p=(80\times2.311)/3.2$ and $P_p=57.2$ pounds. Therefore, as long as the pilot pressure is 57.2 pounds or above, diaphragm 81 will be maintained in closed position.

On the other hand, as soon as the pilot pressure is permitted to drop below the equilibrium pressure of 57.2 pounds, diaphragm 81 will be displaced by the storage pressure $P_s$. Instantaneous with the moment such displacement occurs, the interior margin of the operating diaphragm face, previously sheltered by the rounded end edge 95 of the sleeve (i.e. the region of the face of diaphragm 81 inside the valve "seat"), becomes exposed to the force of the storage pressure $P_s$, thereby enlarging the effective area receiving $P_s$ on the operating side of diaphragm 81. Specifically, the operating surface area as enlarged is equal to 2.619 sq.in (the complete area of the inner side 151 of the ring 4.385 sq.in less the area of the interior opening 2.074") amounting to more than a 25% increase (i.e. 26.3%) in the effective working area of the operating side of the diaphragm. Obviously, the product of the storage pressure and this increased operating area overwhelmingly overbalances the resistance of the pilot pressure on the opposing diaphragm area, causing the opening action of the diaphragm to become virtually instantaneous.

In order to restore the diaphragm to closed condition, one must impose a somewhat greater pilot pressure which can be similarly calculated. Assuming that the storage pressure remains at 80 lbs, the new pilot pressure $P'_p$ times the pilot area must exceed the storage pressure (80#) times the enlarged operating area (2.619). Therefore $P'_p=2.69/3.11\times80\#$ and $P'_p=65.4\#$ which is the minimum pilot pressure needed to restore diaphragm 81 to closed position over the mouth 101 of supply chamber 75. Floating ring 145 is formed of plastic or like low mass material and is preferably held loosely in its operating position in space 141 between the diaphragms by means of a stabilizing lip 153 projecting interiorly from the inner end of casing spacer ring 139, the size of space 141 being sufficient to allow limited free movement of floating ring 145 axially of the nozzle, while restraining ring 145 against possible lateral or rocking movement that might be an aberrant influence on the operation of diaphragm 81.

It will be recalled that the weft strand feed tube 111 extends through casing head 77 and conically shaped core plug 89, projects beyond the apex of the plug through the outer end portion of the bore 107 in core sleeve 85 to a point at least even with the outer face 88 of that sleeve. This means that the nozzle orifice opening 108 is necessarily in the shape of an annulus bounded between the exterior wall of the exposed end of feed tube 111 and the interior wall of the sleeve bore 107. It is an important feature of the present invention common to all embodiments of the weft insertion nozzle thereof that the area of the annulus at the point of least diameter of bore 107 constitutes the minimum area in the entire air flow path through the nozzle. The point of the minimum area of the air flow path defines the throat of the nozzle and a critical requirement of the invention is the occurrence of a choking effect in that throat. Given the re-entrant bend in the air flow path in the present nozzle, with the storage chamber 75 developed as an annulus around the bore 107 and its delivery passageway 105 and the converging nature of passageway 105, it follows that the point of minimum flow area occurs at the point of least diameter in bore 107 in the illustrated embodiments (the total effective flow area of annular passageway 105 being a function of its overall diameter as well as its annular radius). Where other design configurations are employed, the same result may not inherently follow but design of the nozzle in any case will have to comply with this requirement.

In addition, where the supplemental reservoir 137 is employed to augment the flow capacity of storage chamber 75 and thus maintain the full head pressure being delivered to the nozzle orifice, the conduit 138 connecting between the outlet of the supplemental reservoir and the port in the casing wall, together with these ports themselves, must have an effective flow area larger than the effective flow area of the nozzle throat. Since the duration of the air flow during weft insertion will ordinarily consume only a minor fraction of the total working cycle of the loom of the invention, the flow rate capacity of supply conduit connecting between the pressure source and the storage chamber, or the supplemental reservoir, when present, need not fill this same requirement, provided, of course, that in the available replenishment time (between nozzle firings), the amount of air delivered from the supply main to the reservoir and/or the storage chamber is adequate to restore their initial filled condition.

b. Self-Threading Nozzle Feeder

The weft feed tube of the weft insertion nozzle could, of course, be threaded initially by hand using a threading leader of sufficient rigidity as to be insertable into the bore of the feeder tube for drawing the leading end of the weft throughout. However, to facilitate nozzle thread, preferably the nozzle is provided with a weft threading attachment seen to the left of the nozzle itself in FIGS. 3 and 4. This attachment consists of a small cylindrical casing 161 penetrated by an axial feed bore 163 of sufficient diameter to freely pass the weft to be threaded into the nozzle and having a trumpet-shaped inlet opening 165 in one of its end faces. The other end face of the casing fits in abutting contact against the exterior face of the head 77 of the nozzle casing with its feed bore 163 registering with the bore 112 of the nozzle feed tube 111. Surrounding an intermediate section of feed bore 163 is an annular aspirating chamber 167 having forwardly flaring end walls 169, 171 and communicating with the interior of feed bore 163 by way of a small forwardly directed annular opening 173 in its end wall remote from inlet opening 165. By connecting the aspirating chamber 167 to a source of pressurized air a confined high velocity annular stream of air is projected forwardly into feed bore 163, creating a negative pressure and resulting in an aspirating effect in its inlet opening 165. Thus, when the free end of the weft is brought into the vicinity of inlet opening 165, it is sucked into that opening and projected forwardly through the feed tube 111 of the injection nozzle.

To simplify construction of the self-threading attachment, a cylindrical socket 175 having a convexly flared end face is drilled into the casing and a cylindrical plug 177 of reduced axial dimension and having a concavely flared end face is press-fitted into the socket leaving an axial clearance to form chamber 167. An axial aperture 179 passes through plug 177 and its outer end is flared outwardly to form the trumpet-shaped inlet opening 165. A tubular insert 180 fits tightly into axial aperture 179 and extends about the depth of the socket, the insert having an exterior diameter slightly less than the minimum inside diameter of the flared socket wall to define with the open space of the socket the annular chamber 167 having the small annular clearance 173 at its inner end. A supply port 181 connected by a conduit 183 to a source of pressurized air (not seen) is passed radially through casing 161 into annular chamber 167, and as pressurized air flows from the annular chamber into the bore 163, a negative pressure is created in the interior of the tubular insert 180 to positively aspirate the strand into its trumpet-shaped inlet opening.

Alignment of the self-threading attachment with the nozzle inlet can be facilitated forming bore 163 by means of a tubular insert 185 projecting outside the casing 161 for a telescoping fit with an outer portion of the feed tube 111 of the nozzle itself.

In operation, the air pressure supplied to aspirating chamber 167 may be maintained continuously at a level substantially below the operating pressure level of the nozzle, say in the order of 10 to 20 psig.

c. Pilot Pressure Control System for Insertion Nozzle

As previously indicated, the present invention imposes very stringent requirements upon the operating characteristics of the diaphragm valve in that the valve must have the capacity of responding in precisely reproducible fashion at a minimum frequency of 900 cycles per minute combined with an extremely short actuation time, in the order of one ms, and a special control system is provided for actuating the diaphragm valve in accordance with these requirements. The use of a directly operating solenoid valve for controlling pilot pressures acting to actuate the diaphragm valve of the invention, for example, is out of the question at the present state of the valve art. There are available solenoid driven control valves which are capable of a response time in the order of one ms, but these valves can pass only an extremely small amount of fluid in a given time, and this low transmission capacity would introduce such excessive impedance that the required rapid reaction of the diaphragm valve itself is impossible. Moreover, such fast acting solenoid valves are effective in only one direction and are characterized by a much slower response time, in the order of 5–6 ms, on their return stroke. Presently available solenoid valves with an air transmission capacity sufficient for purposes of the present invention have a response time in the order of 10 ms in each of their operating directions which would impose a minimum of 20 ms "delay" for each operating cycle and consequently inherently preclude the achievement of shorter response times.

(1) Electrical Embodiment

Figure 5:
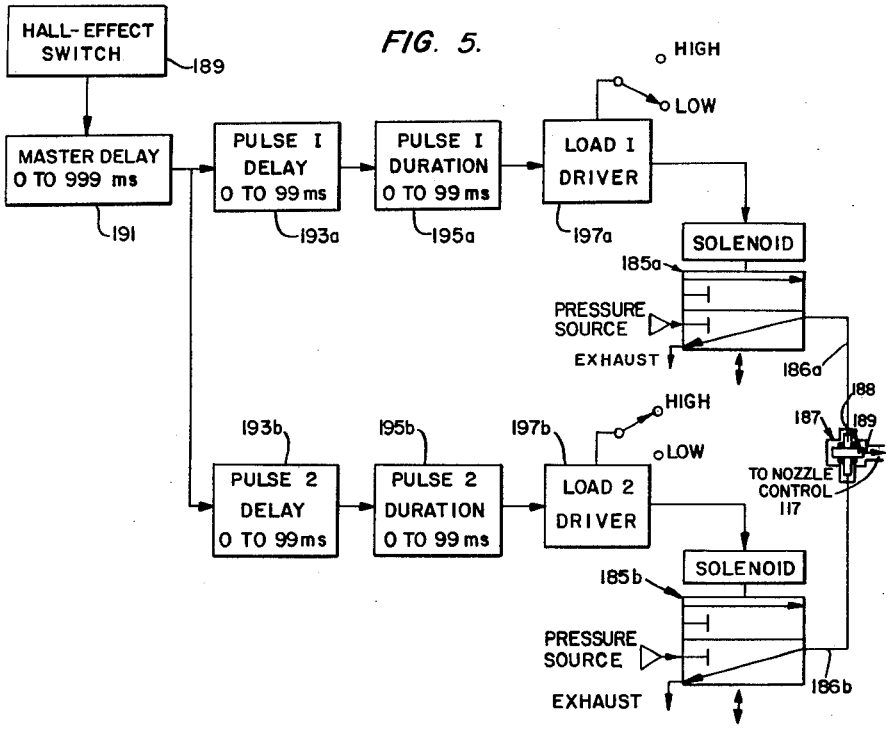
FIG. 5 is a schematic diagram illustrating an electronically actuated air control unit for the insertion nozzle of the invention.

One embodiment of the nozzle control unit in accordance with the present invention, based on electrical principles is illustrated schematically in FIG. 5 and utilizes two separate solenoid servo valves 185*a*, 185*b* (represented diagrammatically) of suitable air transmission capacity connected to the opposite sides of a common shuttle valve 187 which in turn is connected at its output 189 to the pilot port 117 of the casing head 77 of the weft insertion nozzle. Upon electrical energization, each solenoid servo valve moves between a supply position connecting a suitable source of pressurized air to its outlet and an exhaust or "dump" position connecting its outlet to the ambient atmosphere, both valves 185*a*, 185*b* being biased to exhaust position and so shown in FIG. 5. The outlets 186*a*, 186*b* of the respective solenoid servo valve communicate with opposite ends of shuttle valve 187. Each side of the shuttle or piston 188 of valve 187 is effective by means not shown to close the corresponding end of the valve when unbalanced to that end. The outlet port 189 from shuttle valve 187 is located at its midpoint so that the shuttle or piston clears the outlet port in either of its extreme end positions. Hence, when the shuttle is in each extreme position, the outlet of one solenoid servo valve is in full communication with the shuttle valve outlet while the outlet from the other solenoid servo valve is closed by the shuttle. In this way, the shuttle valve isolates each solenoid valve from the other.

The function of this arrangement is illustrated schematically by the wave forms in FIG. 6. As indicated, each solenoid servo valve A, B moves between a supply position in which its wave form a, b is high and an exhaust position in which its wave form is low, the transition from these two positions being shown as a line sloping at an angle determined by the response time or lag of the solenoid. Wave form c represents the shuttle valve, side b of the shuttle being closed when the wave form is low and side a being closed when the wave form is high. The response of the diaphragm valve appears in wave form d, being closed when low and open when high. The actual nozzle output pulse is shown in wave form e, the nozzle being "off" (no air output) when form e is low and "on" (air pulse delivered) when form e is high. It is assumed that at the starting point, the diaphragm valve of the nozzle itself is in closed or seated position (and wave form d is low), while solenoid servo control valve A is in its supply position (and wave form a is high) connecting the supply pressure source to the "a" side of the shuttle valve, thus biasing the shuttle to its "b" side (and wave form c is low), closing off the outlet from the "B" solenoid servo valve, and establishing connection between the outlet of solenoid servo valve "A" and the shuttle valve outlet which applies control or pilot pressure to the control side of the nozzle operating diaphragm valve to maintain that valve closed (and wave form d is low). Solenoid servo control valve B is at this time situated in its exhaust or dump position (and wave form b is low). An operating cycle is initiated at a time $t_1$, indicated by a dash-dot line, to open the diaphragm valve of the nozzle by releasing the control pressure thereon, and solenoid servo control valve A is shifted electrically to its exhaust position, while solenoid valve B remains in its exhaust position. As a consequence, the shuttle valve remains at its "b" side position, but the control pressure acting on the diaphragm valve now begins to be exhausted to the atmosphere through the exhaust of solenoid A at some rate determined by the response rate of the solenoid servo valve as well as the inherent impedance, i.e. line resistance, etc., in the various connecting lines. Therefore, wave form a begins to fall at a sloping rate. When the control pressure acting on the diaphragm falls below a certain calculated level at a time $t_2$, the supply pressure in the storage chamber of the nozzle will then exceed the control pressure, forcing the diaphragm immediately into open position and wave form d goes high. The opening of the diaphragm valve admits pressurized air from the air storage chamber to the nozzle (and wave form e starts high at time $t_2$).

The diaphragm valve remains open, with the weft-projecting air pulse emitting from the nozzle, so long as both solenoid servo valves A and B are in their exhaust (i.e. low) position; and in order to return the diaphragm valve to its closed position and end the nozzle pulse, solenoid control valve B is actuated electrically at a time $t_3$ to shift from its exhaust to its supply position. Thus, solenoid valve B, as seen in wave form b, makes its transition from exhaust to supply position, shown by the sloping line, the slope or rate of which is again determined by the response time of the valve and the impedance of the system as before. Since the opposite or "b" side of the shuttle valve is at this point in communication with the atmosphere, because of the exhaust position of solenoid servo valve A, there is no resistance to the shifting of the shuttle to the "a" side position (and wave form c abruptly goes high), and pressure begins to build up within the control side of the operating diaphragm of the insertion nozzle.

At a certain time $t_4$, the control pressure will exceed the pressure in the storage chamber 75; and when this occurs, the diaphragm moves from its open to its closed position (and wave form d goes low). Since there is no "avalanching" effect in the closing of the diaphragm valve, as occurred in its opening, the closing response of the diaphragm valve is inherently somewhat slower than its snap action opening response (as seen in wave form d), but this has no significant effect on operating efficiency since some decay is unavoidable in exhausting residual air from within the nozzle passageways. It is, however, desirable that the closing response not be excessively long in order to minimize unnecessary consumption of air during each operating cycle, and the alternative nozzle embodiment of FIG. 5 is preferred because it allows the diaphragm to close at a lower level of control pressure and consequently with a higher rate of response. As the diaphragm valve closes, the nozzle pulse is shut off (and wave form e starts low at time $t_4$).

The signals used for controlling the actuation of the solenoid control or servo valves A and B of the embodiment of FIG. 5 are derived electrically as also shown in FIG. 5. Each operating cycle of the control system must occur in timed relation to the operating cycle of the loom itself. The control impulse for initiating each control cycle is preferably derived from the driving crankshaft of the loom itself. To this end, a so-called Hall effect switch 189 is associated with the crankshaft (not shown), this switch consisting of a magnetically operated switch arranged at a point adjacent the crankshaft and a small magnetic element carried on the periphery of the crankshaft itself so that upon each rotation of the crankshaft, the magnetic element passes the switch and activates it to transmit a control signal.

From the preceding discussion of the actuation of solenoid servo valves A and B, it will be realized that means must be present to actuate each solenoid control valve separately at preselected times which desirably are adjustable relative to one another. Also, the timing of the generation of the control signal during the loom operating cycle needs to be adjustable to regulate the timing of the firing of the weft insertion gun and achieve insertion of the weft at the optimum point in the loom operating cycle. This adjustability could be achieved mechanically by changing the location of either the switch or magnetic actuator of the Hall effect switch relative to the crankshaft periphery, but to do this conveniently would require a rather complicated mechanical arrangement, particularly since the loom crankshaft is ordinarily in a relatively inaccessible position. Moreover, a high degree of precision, i.e. within ⅛ of a degree of rotation would be difficult to achieve in this way; hence, an electronic arrangement system for regulating the control signal is much preferred. To this end, a master delay timer 191 is connected to the Hall effect switch and consists of a plurality of, preferably three, decade counters (not shown separately), each adapted to count from 0 to 9 in intervals of 1 ms, and including an associated control dial for setting purposes, the counters being ganged together so as to count continuously from 0 to 999 ms to give an accuracy of 1 ms. Upon receiving the initial control signal from the Hall effect switch 189, the master delay timer 191 begins its counting operation and counts for a given number of microseconds as set on the control dial of its decade counters and after concluding such count, emits a control signal. In this fashion, the master timer, in effect can delay the transmission of the initial control signal in increments of 1 ms up to 999 ms for each loom operating cycle.

The control signal from master delay timer 191 is transmitted separately to each of the solenoid valves by means of separate solenoid control timers **193*a*, 193*b*, which are similar in arrangement and in function to master delay timer 191**, making possible the regulated delay of the timer control signal in increments of 1 ms up to 999 ms (or a smaller or greater total if a coarser or finer degree of control is desired) and depending upon the delay interval set on the dials of the solenoid timers, each such timer will transmit a control pulse at a preselected given interval after receiving the common control pulse from the master delay timer.

The initial control signal generated by the Hall effect switch is of very brief duration and is not sufficient to maintain the actuation of each of the solenoids for the period of time that the valves of these solenoids must remain in open and closed position. Consequently, the control signal from each of the solenoid delay timers 193*a*, 193*b* is delivered to a pulse duration timer 195*a*, 195*b* which functions to prolong or "stretch" the pulse for a given period of time. The pulse duration counter is composed of a gang of two of the decade counters mentioned above to give a capacity of 0 to 99 ms delay in intervals of 1 ms (although a higher precision is obviously possible with additional decade counters if desired). Also, the power of the control signal is ordinarily of a low magnitude, as is true for most "logic" circuits, and is insufficient to electrically drive the solenoid. Each signal must, therefore, be amplified by a driver amplifier 197*a*, 197*b* which switches between high and low, i.e. on and off, conditions in response to the high or low state of the control signal, supplying sufficient power to the solenoid valve for effective electrical actuation thereof.

It will have been understood from the aforegoing description that a highly flexible and precise control system for the weft insertion nozzle is obtained by the just described arrangement. First, the operation of the diaphragm valve is independent of the response times of the individual solenoid servo valves either upon actuation or de-actuation. Since separate solenoids determine the application and release of the control pressure, the lag of the solenoid in returning to starting position is immaterial from the standpoint of any control function, provided, of course, that the lag of the solenoid is not so great that it cannot be returned to starting position in time for the next cycle. Secondly, while the actuations of the solenoid valves are caused fundamentally by crankshaft rotation of the loom, and are hence directly related to the loom operating cycle, the actual timing of such actuation is adjustable with respect to such rotation, giving complete flexibility in regulating the timing of weft insertion relative to the loom cycle. Finally, the timing of the actuation of each solenoid relative to the other is precisely variable and the duration of energization of each solenoid is independently adjustable with a good degree of accuracy.

(2) First Mechanical Embodiment

Figure 7:
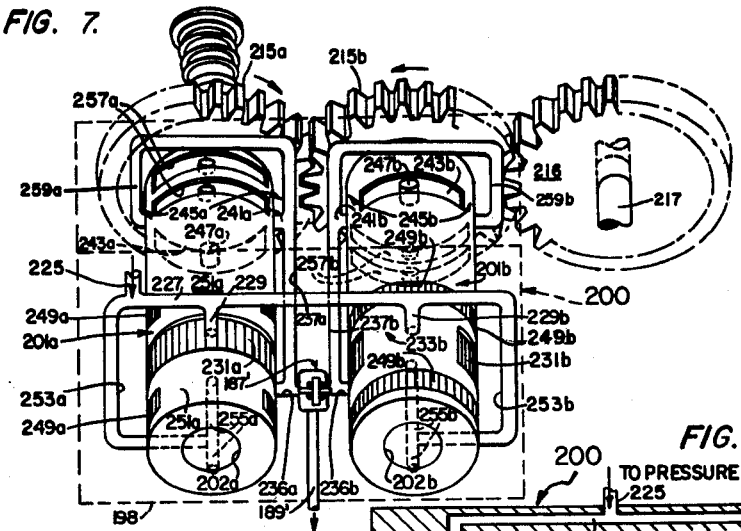
FIG. 7 is a front perspective view on a mechanically operating air control unit for the weft insertion nozzle with the housing in outline and the air passage shown schematically as conduits.
Figure 8:
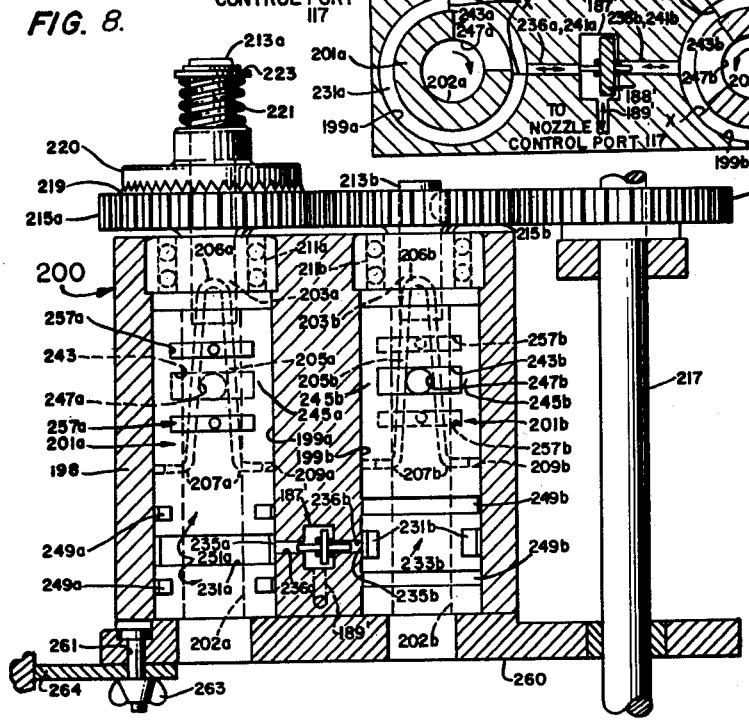
FIG. 8 is a sectional view looking down on the mechanical nozzle control unit of FIG. 7 with the housing shown in cross section and the rotary spools in plan.

The control system of the invention should have the capability of operating many millions of cycles without a failure; and while the electronic system described above is as durable as is possible with electronic components, it may be preferable to utilize instead a mechanical control system which tends to be more reliable over long periods of operation. One alternative embodiment of the nozzle control system based on mechanical principles is illustrated in FIGS. 7 and 8. In general, the mechanical control embodiment includes a pair of valve spools which are mechanically coupled together and to the drive system of the loom, one spool being capable of adjustment in its peripheral relation relative to the other. Each of the spools rotates within a housing and includes on its periphery supply and exhaust apertures located at circumferentially and axially spaced points thereon which during spool rotation are brought into communication with a supply and exhaust port, respectively, in the housing. These ports are in communication via a connecting conduit with a common shuttle valve, similar to the electrical embodiment, so that upon rotation of the spools, the application and release of pilot pressure to the pilot or control side of the operating diaphragm valve of the weft insertion nozzle is regulated.

More specifically, the mechanical system of FIGS. 7 and 8 includes a housing block 198 represented by dotted lines in FIG. 7 and penetrated by two large spaced parallel cylindrical apertures 199*a*, 199*b* (FIG. 8). In each such aperture is fitted a hollow air regulating spool 201*a*, 201*b* with a clearance of about 0.0003" which is sufficiently tight to sustain a moderate air pressure. To minimize wear and avoid the necessity for bearings, each spool 201*a*, *b* is connected in its hollow interior 202*a*, 202*b* to a coaxial drive shaft 203*a*, 203*b* by means of a floating connection which can take the form of an elongaged V-shaped "hair pin" 205*a*, 205*b* having the apex 206*a*, 206*b* of the V secured to the free end of the drive shaft and lateral extensions 207*a*, 207*b* at the ends of the V engaged in recesses 209*a*, 209*b* formed in the interior of the bore of the spool about midway of its length. With this flexible coupling, the spools will rotate bodily with shafts 203*a*, *b* while being free to assume a natural centered position within their respective enclosures, due to the flexibility of the hair spring as well as their pivoted connection thereto. Other types of floating couplings could, of course, be substituted.

Each drive shaft 203*a*, *b* is journaled in bearings 211*a*, 211*b* in an end wall of the housing 198 and includes an exterior extension 213*a*, 213*b* carrying a pinion 215*a*, 215*b*, and both pinions are interengaged to rotate in synchronism. The driving force for the two pinions can be supplied by a gear carried directly on the crankshaft of the loom or, if preferred, the output gear of a mechanical transmission driven from a gear on the loom crankshaft and engaged by one pinion, the driving gear in any case being designated 216 and rotated with a shaft 217. To permit the relative peripheral position of the two spools to be adjusted, one pinion 215*a* is connected to its drive shaft extension 213*a* through an adjustable coupling which may take the form of a pair of abutting discs 219, 220 serrated on their adjacent contacting faces for mating engagement, the disc 219 being integrally united to pinion 215*a* which rotates freely on its shaft extension 213*a* and the disc 220 being slidingly keyed to the projecting end of the shaft extension and biased against the pinion disc 219 by means of a compression spring 221 held at its free end with a split ring fastener and washer 223. By disengaging the keyed disc 220 from the pinion disc 219 against the force of compression spring 221, shaft 213*a* can be turned independently of its drive pinion 215*a* and thus the rotary position of spool 201*a* can be shifted as desired relative to the rotary position of the other fixed spool 201*b*. The ends of the apertures 199*a*, *b* in the spool housing are open to vent the hollow bore of each spool 201*a*, *b* to the atmosphere.

The housing 198 is constructed with a series of air passageways for cooperation with spool valves 201*a*, 201*b*, and in FIG. 7, for sake of clarity and convenience, these passageways are developed and shown as external conduits (the housing itself being indicated only in dotted lines), although in reality these passageways would be formed internally of the housing). The beginning of the passageway is an inlet opening indicated at 225 which is connected to a source of pressurized air (not shown), and in turn connects with a supply conduit 227 from which branches supply ports 229a, 229b (see FIG. 8), one for each of the two spools. At a point along its length in axial registration with the associated supply ports 229a, b, each of the spools 201a, b carries a peripheral supply recess 231a, 231b which extends around the periphery of each spool for a given arcuate extent less than 360°, say 270°, the remaining arc of the spool periphery at this point being solid or unrelieved, as at 233a, 233b (only the latter of which can be seen in the drawings). When one of the supply recesses 231a, b coincides with its corresponding supply port, air under pressure is admitted from supply line 227 to fill the supply recess, while, contrariwise, when an unrelieved wall portion 233a, b coincides with a supply port, the supply port is blocked as to air flow by reason of the tight fit of the spool in the housing aperture. At the same axial or lengthwise point along each spool but spaced peripherally from the supply ports 229a, b is a delivery port 235a, 235b (see FIG. 8) which connects by a delivery line 236a, 236b to the corresponding side of a shuttle valve similar to the shuttle valve 187 of the electrical embodiment and designated 187', the shuttle valve here as in the other embodiment having its outlet 189' connected to the pilot or control port 117 of the insertion nozzle. Thus, when a spool supply recess 231a, b, filled with pressurized air, coincides with a delivery port 235a, b, air flows into the delivery port and through the delivery line to the shuttle valve 187' while when an unrelieved peripheral portion 233a, b coincides with the delivery port, that port is blocked.

Between its delivery port 235a, b and connection with the shuttle valve, each delivery line 236a, b branches as at 237a, 237b (FIG. 7) to form an exhaust line terminating in an exhaust port 241a, 241b (not seen in FIG. 8) in peripheral alignment with but displaced axially along the spool length from the corresponding delivery port 235a, b. At a point along each spool length axially aligned with the exhaust port 241a, b, an exhaust recess 243a and 243b is formed on each spool periphery and each such exhaust recess has a peripheral extent complementary with the peripheral extent of the delivery recess 231a, b with the remaining periphery solid or unrelieved as at 245a, b. That is to say, the arcuate extent of each exhaust recess 243a, b equals the arcuate extent of the unrelieved surface portion 233a, b interrupting the ends of each delivery recess 231a, b, whereas the remaining unrelieved portion 245a, 245b of the spool periphery at each exhaust recess matches the peripheral dimension of the delivery recess 231a and b. A vent 247a, 247b extends from the bottom of each exhaust recess 243a, b and the interior bore 202a, b of the associated spool so as to vent the recess space to the atmosphere. Thus, when one of the exhaust ports 241a, b coincides with its exhaust recess 243a, b, communication is established between the shuttle valve 187' via delivery port 235a, b, exhaust branch line 237a, b, exhaust port 241a, b, exhaust recess 243a, b, and exhaust vent 247a, b, and the ambient atmosphere. On the other hand, when the unrelieved peripheral portion 245a, b of the spool coincides with an exhaust port, that port is blocked.

As described before, the relative starting positions or the two rotary spool valves will be different, being shown as 180° out of phase in FIGS. 7 and 8, and can be adjusted as desired. It follows that as each spool valve rotates, supply and delivery ports for a given spool will be in communication with one another via the common delivery recess 231a, b for a period of each revolution determined both by their peripheral separation and by the peripheral length of the delivery recess, and while such communication exists, pressure is delivered to the corresponding side of the shuttle valve 187', whereas the exhaust port 241a, b during this period will be blocked. The exhaust port 241a, b, on the other hand, will be in communication with the atmosphere (through the exhaust recess 243a, b, vent and spool bore) for a period according to the peripheral length of exhaust recess 243a, b, during which period the corresponding side of the shuttle valve will be exhausted. During the latter period, the corresponding delivery port is blocked by the solid peripheral surface 233a, b complementary to the exhaust recess extent at their common axial position. While either of the delivery port 235a, b or supply port 229a, b of a given spool is blocked, delivery of pressure to the corresponding side of the shuttle valve is precluded, even though the other port is in communication with the supply recess. When the supply and delivery ports are both open to the delivery recess, the exhaust port for that spool must be blocked. The peripheral positions of the respective spools are independently adjustable so the above actions can be arranged to occur in a desired sequence.

In the aforegoing construction, each spool receives the radial thrust from the several flows of pressurized air and, in time, the radial biasing force of the pressurized air would cause unacceptable wear of the spool unless compensatory measures were adopted. For this purpose, counterbalancing supply grooves 249a, 249b are provided on each spool on the opposite axial sides of the supply recess, the aggregate axial thickness of these grooves and their peripheral dimensions being each equal to that of the supply groove but 180° out of phase. That is, the unrelieved portions 251a, b between the ends of each pair of counterbalancing supply grooves 249a, b is exactly diametrically opposite to the unrelieved portion 233a, b between the ends of the corresponding supply recess situated between them. The supply line 227 from the pressure source includes extensions 253a, b which are branched at their end as at 255a, 255b for communication with respective counterbalancing grooves 249a, b to supply air to those grooves in balancing opposition to the air impinging upon the supply recess 231a, b from its supply port.

Similarly counterbalancing exhaust grooves 257a, 257b are provided on each spool periphery equal in arcuate extent and aggregate axial thickness but opposite in peripheral location on the opposite sides of the exhaust recesses, and exhaust line extension 259a, 259b open onto these grooves to apply counterbalancing pressure.

In addition to independent adjustment of the spool relative to one another, the starting position of the entire spool assembly should also be adjustable relative to the crankshaft of the loom to vary the overall starting point in the loom operating cycle (analogous to the master delay timer 191 of FIG. 6). To this end, the housing for the two rotary valve spools 201a, 201b (which could, of course, be made separate instead of common) is carried by a supporting plate 260 mounted for pivotal movement around the shaft 217 of driving gear 216 (i.e., the loom crankshaft or an output gear of a transmission coupled thereto making one revolution per loom cycle) and plate 260 can be adjusted on the fixed support 261 arcuately relative to the driving gear within the limits provided by an arcuate adjusting groove 261 and butterfly nut 263 therein. By properly locating spool support plate 260 at the start of an operation, the starting position of the fixed spool relative to the crankshaft position can be adjusted so as to give a measure of flexibility in setting the timing of the firing of the gun in relation to the loom operating cycle. In the embodiment shown, the range of adjustment is less than 100%, but since the interval in the loom cycle during which weft insertion is possible is only a fraction of the overall cycle, 100% adjustment is not needed as a practical matter, and a degree of adjustment equalling about 20° of rotation is quite adequate in practice. If more latitude is needed, the driving gear can be readjusted in rotary position.

As in the electronic control embodiment of FIG. 5, the control functions of opening and closing the diaphragm valve are effected in the mechanical embodiment by individual instrumentalities which operate separately but in determined adjustable time-related fashion, one of the spools functioning to release the control pressure from (and open) the diaphragm valve while the other spool functions to apply control pressure to (and close) that valve. Specifically, it is the rotation of the first or leading spool into supply position with both its supply and delivery ports opening into its supply recess that initiates application of the control pressure to close the diaphragm valve—the subsequent rotation into supply position by the second or trailing spool is immaterial (except to position the second spool for eventual movement to exhaust position) as is the rotation of the first spool into exhaust position. Conversely, it is the rotation of the second or trailing spool into exhaust position while the first spool is already in exhaust position that initiates release of the control pressure to open the diaphragm valve—the prior location of the first spool in its exhaust position is immaterial except to position it for eventual movement to its supply position.

The shuttle valve shifts in position in passive response to an unbalance in pressure applied to its sides by the delivery conditions of the two spools and functions to permit only one spool at a time to deliver control pressure to the diaphragm valve. When the effect of a change in the rotary position of a spool is merely to bring the pressures on the opposite sides of the shuttle valve into equilibrium, whether such pressures be high during delivery or low during exhaust, the shuttle valve holds its existing position.

The maximum period possible between release and reapplication of control pressure to the diaphragm valve, and hence the period the diaphragm valve remains open (disregarding lag due to impedance losses), occurs where the two spools exactly coincide in peripheral position and equals the time equivalent of the arcuate length (i.e. in degrees of rotation) of the exhaust recess at a given speed of spool rotation. However, exact coincidence of the two spools would be the same as a single spool and would normally not be used. The arcuate length of the exhaust recess does obviously fix the maximum time of pulse duration and should be selected with this in mind. By shifting the starting rotational position of one spool relative to the other, the relation in time of the two control functions can be changed and the duration of the exhaustion period and thus of the nozzle pulse can be varied up to the available maximum. The diaphragm valve does not open exactly simultaneously with the rotation of the second spool into exhaust position but lags somewhat therebehind since the control pressure must drop to some critical level and the rate of pressure drop in practice is determined by the impedance of a particular system and must be established experimentally for that system. Once established, it remains constant in relationship to spool rotation and thus, the actual timing in practice of the actuation and de-actuation of the nozzle valve is fixed by the spool rotation. After a preliminary adjustment, both spools rotate continuously in synchronized relation to the operation of the loom and to each other.

The response of the mechanical embodiment of FIGS. 7 and 8 is identical in principle to that of the electronic embodiment of FIGS. 5 and 6, except that the mechanical embodiment includes an intermediate "dwell" or hold condition represented in dotted lines in FIG. 6, not present in the electrical embodiment, in which the spool valve is neither actually applying nor exhausting pressure but simply maintains whatever condition existed previously. Specifically, assume that for each spool the exhaust recess 243*a*, 243*b* extends through an arc of 90° of rotation and the supply recess 231*a*, 231*b* is complementary thereto and extends over 270° of rotation. Assume also that spool A is rotating clockwise, while spool B is rotating counterclockwise as indicated by the arrows in FIG. 7 and that the supply port for each spool is situated 90° in advance of the delivery port relative to the direction of rotation. Finally, assume that spool B is initially rotated 45° in its direction of rotation ahead of spool A and that the starting point corresponds to time $t_1$ in FIG. 6.

Figure 9:
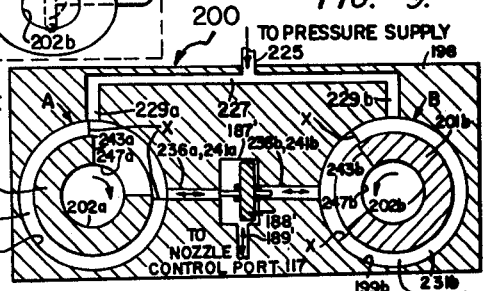
FIG. 9 is a vertical section somewhat diagrammatic taken through the control unit of FIGS. 7 and 8, showing details of the rotary spools thereof.

As a point of reference, FIG. 9 is a diagrammatic cross-sectional view taken through the control spools of FIG. 8 in their starting position, the sectional line being such as to show both the supply recesses 231*a*, *b* and the exhaust recesses 243*a*, *b* in relief notwithstanding their actual axial displacement from one another, the transition between the supply and exhaust recesses being indicated diagrammatically by a thin solid wall designated x, with each exhaust recess being shown opening to the spool bore while each supply recess is closed by the spool wall. The line connecting between each spool in FIG. 9 with its side of the shuttle valve 187' is designated both as a delivery line 236*a*, *b* and an exhaust line 241*a*, *b* since the delivery and exhaust lines are in the same peripheral location and are in open communication with one another. As appears in FIG. 9, the starting position of spool A is rotated 135° counterclockwise from the position of the left spool in FIG. 7, while the starting position for spool B is rotated 90° counterclockwise from the right hand spool in FIG. 7. In these positions, spool B is already in exhaust condition, the B exhaust port 241*b* being midway of the B exhaust recess 243*b* (and wave form b in FIG. 6 is low); whereas the exhaust recess 243*a* for spool A have just been brought into coincidence with the A exhaust port 241*a* so that the A spool is just beginning to exhaust (and wave form a has just gone low). The shuttle valve is in its "b" side position (and wave form c is low); control pressure is being released from the nozzle, and at a certain time $t_2$, the control pressure falls sufficiently low that the diaphragm valve snaps open (wave form d going high at time $t_2$) and the nozzle pulse begins (wave form e going high). These conditions hold for the next 45° of rotation to time $t_3$, at which time spool B has rotated exhaust recess 243*b* just past exhaust port 241*b* and is in supply condition with its supply and delivery ports 229*b*, 236*b* in communication with the B supply recess 231*b*. Hence, at time $t_3$ pressure is applied to the "b" side of the shuttle valve 187' shifting the same to its "a" side position. Thus, wave form b goes high as does wave form c. This same 45° rotation for spool A effects no change in the exhausting condition of spool A (and wave form a stays low). The application of pressure by spool B to the shuttle valve 187' is transmitted to the control port of the nozzle and pressure begins to build up against the nozzle diaphragm valve. At a certain time $t_4$ the control pressure overwhelms the nozzle pressure, and the diaphragm valve closes (wave form d going low). Closure of the diaphragm valve ceases the flow of air into the nozzle, and the nozzle pulse begins to decay (and wave form e starts to go low).

After 90° of rotation, spool B remains in supply condition (and wave form b continues high), and the shuttle valve and diaphragm valve are held as before (and wave form c remains high, while wave form d remains low); whereas spool A has advanced from exhaust to supply condition (and wave form a goes high), which, however, has no effect on the system since spool B is already in supply condition. At 135° of rotation, the system remains stable in all respects which continues for another 90° of rotation or until a total of 225° of rotation at which point the supply port for spool B becomes blocked by the unrelieved portion 233*b* of the B supply recess which holds the existing pressure condition on the shuttle valve and diaphragm valve. Wave form b drops to its intermediate hold condition indicated in dotted lines in FIG. 6. Spool A remains in supply condition during this time and for an additional 45° of rotation to a total of 270° of rotation, at which point spool A moves into hold condition (and wave form a drops to its intermediate dotted line position) while spool B remains in hold position. When the 315° point is reached, spool B has its exhaust port coinciding with its exhaust recess and begins to exhaust (wave form b moving low). The pressure being held in spool A (due to its hold condition) urges the shuttle valve to its "b" side position (and wave form c goes low) which continues to hold the control pressure against the diaphragm valve (and wave form d remains low). The final 45° of rotation brings the system to the starting point at time $t_1$ at which point spool A goes into exhaust condition and a new cycle commences.

In practice, the extent the two spools would be adjusted out of phase may differ from the 45° assumed above according to whatever pulse length may be desired and the frequency of the loom cycle per unit time. The pulse duration depends upon the length of time both spools are in exhaust and can be varied by changing the relative times at which the last spool goes low and the first spool goes high.

(3) Mechanical Embodiment-Alternative Design

In the mechanically operating embodiment of FIGS. 7–9, a shuttle valve must be interposed between the delivery ports of the two spools in order to prevent a cross-connection between these delivery ports which would allow a pressure condition applied by the supply recess of one spool to vent directly to the atmosphere through the exhaust recess of the other spool and result in loss of control over the working of the diaphragm valve. It is possible to provide a modified the design 200' for the spool array to eliminate the presence of the shuttle valve and one modified design functioning in this way is illustrated in FIGS. 10–12. Except for the elimination of the shuttle valve 187', the housing and driving means of the alternative embodiment are the same as in the initial unit and for sake of clarity, in the diagrammatic perspective view of the FIG. 10, the driving gears, shafts and the like are omitted, and the housing is shown only in outline by dotted lines as at 198', the various air passageways which would in reality be formed as bores within the housing being developed as independent conduits for sake of clarity. Housing 198' encloses apertures 199'*a*, 199'*b* in which the spools 201'*a*, 201'*b* fit. The spools themselves are identical, except that they have opposite directions of rotation and have an opposite "hand". At the opposite ends of each spool there are solid collar-like sections 204*a*, 204*b* and 206*a*, 206*b* which form a pressure holding fit when the spools are mounted in the housing 198' and apart from several unrelieved regions or "islands", to be described, the spool periphery between these end collars 204*a*, *b* and 206*a*, *b* is relieved or of reduced diameter, as at 231'*a*, 231'*b*, to form a continuous annular chamber. A supply line 227' (see FIG. 10) connected to a supply source of pressurized air (not shown) branches to form supply ports 229'*a*, 229'*b* so that the respective supply chambers are continuously supplied with pressurized air.

At an intermediate point along the length of each spool the annular supply recess is interrupted by an unrelieved full diameter arcuate region of the spool periphery or island 242*a*, 242*b* and an end section of each such island has its interior cut away as at 243'*a*, 243'*b* to form an exhaust recess which communicates through an axial vent 247'*a*, 247'*b* (see FIG. 11) with the interior bore 202'*a*, 202'*b* and thus with the surrounding atmosphere. A delivery port 235'*a*, 235'*b* is arranged at corresponding points on the periphery of the spool apertures 199'*a*, 199'*b* and at an axial location within the axial limit of island 242*a*, 242*b* so that as each spool rotates, the associated delivery port can be placed selectively into communication with a supply recess, or with an exhaust recess (in which case communication also with the supply recess is prevented by the marginal edges of the island around the exhaust recess serving as a seal between the exhaust recess and supply recess) or be blocked by an island itself. The two delivery ports 235'*a*, *b* connect to a common delivery conduit 236 which connects to the control port of the nozzle via conduit 189''.

The rotary spools of the alternative design will likewise be subjected to radial forces which would in time result in excessive wear, and it is preferred in this embodiment also that counterbalancing means for such radial forces be provided similar to those already described in the initial embodiment. To this end, each island 242*a*, *b* and exhaust recess 243*a*, *b* is duplicated 180° out of phase by a pair of counterbalancing islands 249'*a*, 249'*b* and recesses 251'*a*, 251'*b*, one pair located to either side in the axial sense of the main island, and together equalling the peripheral and axial dimensions of each main island and exhaust recess, respectively. The recesses 251'*a*, 251'*b* are vented to the atmosphere as at 252*a*, 252*b*. Each set of counterbalancing islands 249'*a*, *b* and recesses 251'*a*, *b* has an associated counterbalancing port 255'*a*, 255'*b* which are connected to the same delivery conduit 189'' as the delivery ports 235'*a*, 235'*b*. Thus, whatever pressure is applied to each island or exhaust recess of each spool is exactly counterbalanced by an equal but opposite pressure applied to the counterbalancing islands and recesses.

The operation of the alternative mechanical embodiment closely resembles that of the main embodiment, and a wave form diagram illustrating the cyclic operation of the alternative form appears in FIG. 12 (wave forms c and e being absent since the shuttle valve is omitted and the nozzle pulse is unchanged). If both spools are in exhausting condition (i.e. both wave forms a and b are low) or one spool is in exhausting condition and the other spool is hold or blocking condition (i.e. either of wave forms a and b is low and the other is intermediate), then the nozzle operating diaphragm valve will be open (wave form d being high) and the nozzle will be emitting a pulse. Conversely, if both spools are in supplying condition (i.e. both wave forms a and b are high) with their delivery ports communicating with a corresponding supply recess, or if one spool is in supplying condition and the other in hold or blocking condition (i.e. either of wave forms a and b is high and the other is intermediate), control pressure will be delivered through control conduit 189" and applied against the diaphragm valve to close that valve (wave form d being low) and terminates the nozzle firing pulse. Since the relative positions of the exhaust recess and blocking islands are reversed in the two spools, the island leading in one spool, while the exhaust recess leads in the other spool, one spool will be blocking or hold condition while the other spool is in exhausting condition and by varying the angular relationship of the two spools, i.e. the arcuate distance represented by y in FIG. 12, the length of time that the diaphragm is free of control pressure and thus the length of the nozzle pulse can be adjusted. Maximum pulse duration occurs when spool A moves to hold position simultaneously as spool B moves to exhaust position; while minimum pulse duration occurs when both spools move simultaneously to exhaust position. In FIG. 12 wave forms a and b have been drawn in positions representing the maximum relative separation of the two spools, i.e. maximum possible length for y, the nozzle remaining open for a total of 90°, for sake of clarity. In practice, the interval between opening and closing of the diaphragm valve would normally be considerably smaller and in any case, the arcuate extent of the islands and recesses can be modified to suit the circumstances.

II. Operation of the System of the Invention a. Introduction

In the course of the preceding detailed description of the apparatus of the system of the present invention, considerable information has already been conveyed, either directly or indirectly, as to the mode of operation that is followed in the practical utilization of this apparatus. However, certain process conditions are of peculiar importance in the invention and need more detailed description augmented with actual test results.

Some preliminary general comments might be helpful to an understanding of the results of these tests which, basically, involve the projection through the warp of a standard 48" loom of a proper length of yarn drawn from the weft metering and storage device described above through a "standard" weft guidance tube utilizing a given combination of nozzle configuration and test conditions. For this purpose, a "standard" guidance tube is 48" in length, composed of 310 equally spaced annular elements, one for roughly every 12 warp strands, each ⅛" in thickness (i.e. axial dimension) and having a ¾" diameter honed internal bore. For each test, the supply chamber of the nozzle, and the accummulation reservoir where present, are pressurized with air to a given "supply pressure" by an uninterrupted connection to a pressure main of the same pressure, and the actual values of the "supply pressure" are measured by means of a pressure gauge (not shown) communicating with the interior of the nozzle supply chamber. A feed tube having an outside diameter of 0.0095" is arranged within each nozzle with its free end projecting approximately ⅛" beyond the plane of the exit of the contoured section exclusive of the extension barrel where present, and the weft to be projected is introduced into the feed tube with its leading free end projecting a short distance, e.g. approximately 1", exteriorly of the feed tube end, and simulating a practical weaving condition where the weft is cut between the nozzle and fabric edge.

After the nozzle has been activated or "fired" with a sufficient level of supply presure, the weft length will be projected through the nozzle and into the guidance tube. For a given nozzle arrangement and set of test conditions, the time required for the free end of the weft length to traverse the entire length of the guidance tube and emerge from the far end thereof has been found to be reproducible with a reasonable level of accuracy, and this time, referred to herein as the "weft arrival time" is a useful characteristic in evaluating the effectiveness of the particular test conditions. For consistent evaluation, a distance of 52" has been fixed as a practical test distance the weft must travel for measuring these weft arrival times, this distance including the guidance tube itself and sufficient clearance space at either end to approximate what would be needed in actual practice on a 48" loom.

The technique used for measuring the "weft arrival times" is as follows: A stroboscope is located at the fixed test distance from the nozzle (outside the egress end of the guidance tube), the stroboscope being activated by means of an adjustable interval timer, calibrated in microseconds, which is started by the firing of the nozzle itself so that the strobe flashes after passage of whatever interval of time is set on the timer following the instant of nozzle firing. The egress end of the tube is then visually observed by a human observer to see the location of the leading end of the weft when the stroboscope flashes. The test is repeated with appropriate adjustments of the timer by trial and error until the leading end of the weft can be seen just reaching the 52" test point at the moment of the flash. This technique is simple with a good degree of reproducibility virtually free of human error and can easily be recorded for subsequent confirmation with a camera viewing the test point. Once the timer reading matching the instant of arrival of the weft is formed, the test is repeated once or more times to insure accuracy. When measured in this fashion, weft arrival times accurate to 1 millisecond (ms) have been obtained with reasonable consistency.

The firing of the nozzle will deliver a burst of air into the guidance tube and the emergence of this flow of air can be detected (and actually felt by hand), and, here again, the time required for the air current to traverse the given fixed distance, namely 52" is generally reproducible for a given set of conditions and has been found to provide an indication of the maximum theoretical efficiency that a given arrangement is capable of achieving under a given set of conditions. The period of time for the air burst to pass through the tube and reach the fixed end point is referred to herein as "air arrival time" and is preferably measured by means of a hot wire anemometer situated at the fixed point and connected to the recording oscilloscope measuring the lapse in time in milliseconds between firing of the nozzle and response of the anemometer. As is known in the art, a hot wire anemometer changes in electrical resistance in response to fluctuations in its ambient temperature, which resistance changes can be detected by a recording oscilloscope. Since a change in the velocity of air ambient to the hot wire produces a temperature fluctuation at the wire, this device effectively detects the instantaneous arrival of the air flow at the fixed point.

As is well known from the principles of fluid flow, the pressure which is actually delivered to the throat of a nozzle is virtually never the same as the supply or line pressure since the pressure level which can be "seen", i.e. received, by the nozzle throat will necessarily be affected by the inherent resistance of impedance in the connections existing between the supply lines and the nozzle itself. The term "head pressure" or "stagnation pressure" is used in the art to differentiate actual nozzle pressure from supply or line pressure, and this distinction is followed here. Specifically, the term "head pressure" or the equivalent "stagnation pressure" as employed in describing the various tests carried out here is intended to mean the pressure measured by a strain gauge pressure transducer mounted about the midpoint of the delivery passage of the nozzle upstream of the throat, as indicated roughly by the dotted lines designated 114 in FIG. 4, the signal from this transducer being delivered to a recording oscilloscope. On the other hand, the term "supply pressure" is that pressure measured by a gauge connected to the supply chamber which will be in equilibrium with the line pressure before nozzle activation.

With these preliminary explanatory observations, the discussion will now address particular operating conditions.

b. Nozzle Pressure

It is of critical importance to the present invention that the "head pressure" of the nozzle be sufficiently large to achieve a "choking" condition at the throat of the nozzle itself and not upstream or downstream of the nozzle throat. The term "choking" has been derived from the field of aeronautical testing, e.g. wind tunnel testing, and is accepted to mean the delivery to the nozzle of air under sufficient pressure that the velocity profile across or transversely of the air flow passing through the throat area uniformly equals sonic velocity, i.e., has a velocity of Mach No. 1.0. Generally, it is known that a nozzle throat will be "choked" in this sense when the ratio of the head or stagnation pressure actually available to the throat itself to ambient pressure is at least 1.894/1. Contrary to the experience of aerodynamic testing where choking is an undesirable phenomenon, it is essential in the practice of the present invention that a choking condition be produced directly in the nozzle throat and not before or after that throat in order to maximize the thrusting capability of the nozzle upon the strand disposed therein.

Thus, the throat of the nozzle of the present invention must constitute the point at which maximum impedance occurs within the delivery connections between the pressure source and the nozzle throat, including impedance due to turbulence of flow as well as boundary layer phenomena. By the term "boundary layer phenomenon" is meant the tendency of a layer of fluid adjacent a stationary surface or boundary to be substantially stationary and exert resistance to the flow of fluid along that surface, the extent of such resistance increasing as the surface length increases. To this end, the air supply components of the present invention are especially designed to allow air to flow therethrough with minimum impedance losses of all kinds, the distances between the pressure supply source, i.e. the supply chamber and accumulator and the nozzle being as short as reasonably possible, and all connecting lines being of sufficiently large size as to eliminate significant impedance. Further, the delivery passageways extending from the supply chamber to the throat are carefully contoured for turbulent-free flow together with sufficient circumferential dimension as to substantially exceed, e.g by a factor of about 5, the actual throat cross-sectional area, notwithstanding roughly equal radial or annular dimensions, bearing in mind that the annular throat area of the present nozzle is reduced by the presence of the feed tube therein.

As already stated, the basic determinant of nozzle choking is the existence of a pressure relationship between the nozzle head pressure and the ambient atmosphere in the order of approximately 2:1, and the achievement of this ratio is the prime indicator of the occurrence of a choking condition. However, additional indications of this condition are provided by the quantitative relationship of the head pressure to the supply pressure, in that the head pressure for a choked nozzle will tend to more closely approach the supply pressure and by the pressure "history" for the nozzle obtained during a cycle of operation. If the pressure transducer communicating with the nozzle delivery passage just upstream of the nozzle throat is used to continuously record on an oscilloscope the pressure at that point during an operating cycle, the pattern of this recording gives a pressure trace or "pressure history" which reveals significant information about the nozzle, as will be explained.

Where the nozzle length is extended to project, e.g. by means of a barrel, downstream of the throat region which can be advantageous for certain purposes, care must be taken to insure that the length of such extension is not such as to superimpose upon the system a subsequent or downstream "choking point" that would defeat the critical requirement of the invention of choking directly at the throat. The boundary layer effect in an extended cylindrical tube introduces an increasing resistance or impedance according to the tube length, which is comparable in effect to a physical restriction analogous to a throat, and this effect cannot be permitted in this invention to develop to the extent of creating a "virtual throat" smaller than and downstream of the actual throat.

In order to give a comparison between a variety of different nozzles for the purpose of the present invention, extensive testing has been carried out with nozzles of different contours and dimensions, and the results thereof appear hereinafter.

c. The Nozzle Contour

For purposes of this invention, the contour of the nozzles does not appear to be critical and is subject to considerable variation. Early in the research underlying this invention, the hypothesis was drawn that a nozzle designed to produce supersonic air flow would be distinctly advantageous, if not crucial, to optimum high speed projection of weft strands in a loom. Subsequent working data have disproved this hypothesis in that while a nozzle designed for supersonic flow is certainly suitable for the practice of the invention, virtually the same operating efficiency can surprisingly be attained by nozzles which are not designed for supersonic flow.

(1) "Supersonically Contoured" Nozzle

The design of the nozzle contoured for supersonic flow has been thoroughly explored in the aerodynamic field and requires no detailed explanation here. Briefly, a so-called supersonic nozzle requires an outlet opening located downstream of a converging throat, the ratio of cross-sectional areas of the outlet opening relative to the throat being greater than 1, with the interior nozzle wall in the region between the throat and outlet being smoothly diverging in contour. With such a nozzle, the air flow at the throat reaches sonic velocity and, if pressurized sufficiently, upon entering the downstream divergent area will undergo an expansion with consequential acceleration to above sonic speeds. The degree of expansion and consequential flow acceleration determines the maximum velocity capability of the nozzle, i.e. its effective Mach number, and each nozzle must have its design parameters carefully selected in accordance with its intended design Mach number capability when operated at a given design pressure level. It is preferred that the divergent contouring be such as to produce flow expansion under carefully controlled conditions to thereby preclude the possibility of so-called shock wave formation caused by undesirable over expansion and subsequent collapse or recompression of the flow current to restore equilibrium. Also, the exit pressure at the outlet opening should ideally speaking, exactly equal atmospheric pressure for the same reason of avoiding shock wave formation. Calculations establishing the precise contours required for supersonic nozzles over a range of Mach number capabilities have been evolved in the aerodynamic art and additional practical information on this subject can be found in the paper "The Design of Supersonic Nozzles" by A. McCabe, the British Aeronautical Research Committee (BARC) Reports and Memoranda, No. 3340, 1967, while a theoretical treatment appears in the text *Aerodynamics of a Compressible Fluid* by Leipmann and Puckett, John Wiley & Sons, New York, 1947, especially pages 30–37 and 218–232. For present purposes, precise application of these calculations has not been found essential and an approximation acceptable for the invention can be obtained by simply establishing (e.g. with so-called "French curves") a smoothly curved divergent contour between the throat area and the exit opening of the nozzle.

To demonstrate the behavior of supersonically contoured nozzles, which for convenience are referred to here as "contoured nozzles", a series of tests were carried out with a given contoured nozzle alone and modified by the addition of extension barrels of varying length, such barrels being uniformly cylindrical in shape with a diameter matching the exit diameter of the nozzle and a length related to the nozzle exit diameter by factors of 5, 10 and 20, respectively. The nozzle in this case was designed with a throat cross-sectional area of 11 mm$^2$, a throat diameter of 0.175", and an exit diameter of 0.186" to give a Mach number of approximately 1.5 for a "design" stagnation pressure of 39.3 psig. The axial distance between the plane of the throat area and the plane of the exit opening is 0.120", and the nozzle surface is smoothly contoured in divergent fashion from the throat to the exit opening. The test results for these nozzles operated at supply pressures ranging from 40 to 120 psig, in 10 psig increments, in terms of air arrival times, weft arrival times as well as the effective head pressures attained appear in Table I below, while the data from this table for weft and air arrival times versus supply pressure for all four nozzles in plotted in FIG. 13, the respective nozzles being designated according to the legend appearing on that figure.

TABLE I

| | Effect of Extension Barrels on Contoured Nozzle | | | | | | | | | | | |
|---|---|---|---|---|---|---|---|---|---|---|---|---|
| | Air Arrival Time (ms) | | | | Weft Arrival Time (ms) | | | | Head Pressure (psig) | | | |
| Supply Pressure | No Bbl | 5 × D Bbl | 10 × D Bbl | 20 × D Bbl | No Bbl | 5 × D Bbl | 10 × D Bbl | 20 × D No Bbl | Bbl | 5 × D Bbl | 10 × D Bbl | 20 × D |
| 40 | 37 | 35 | 34 | 35 | NA | NA | 56 | 58 | NA | NA | 40 | 39 |
| 50 | 30 | 30 | 30 | 32 | 98 | 45 | 42 | 42 | 48 | 48 | 48 | 50 |
| 60 | 27 | 27 | 26 | 28 | 53 | 36 | 36 | 34 | 57 | 57 | 60 | 59 |
| 70 | 26 | 24 | 25 | 25 | 50 | 34 | 30 | 30 | 67 | 68 | 70 | 68 |
| 80 | 24 | 23 | 23 | 24 | 44 | 33 | 29 | 27 | 78 | 78 | 78 | 78 |
| 90 | 23 | 22 | 22 | 23 | 33 | 27 | 27 | 26 | 88 | 90 | 90 | 87 |
| 100 | 21 | 21 | 20 | 22 | 29 | 27 | 26 | 23 | 99 | 99 | 98 | 97 |
| 110 | 20 | 20 | 19 | 21 | 27 | 25 | 23 | 23 | 110 | 108 | 110 | 108 |
| 120 | 18 | 19 | 18 | 19 | 26 | 23 | 21 | 21 | 120 | 120 | 120 | 120 |

The indication "NA" means "no arrival", i.e. the weft length could not be projected across the 52" test length at the corresponding condition.

From the data of Table I several conclusions can be drawn. The effect on the air arrival times across this broad supply pressure range of the addition of extension barrels to a contoured nozzle is minimal—the curves representing air arrival times for the four nozzles cluster closely together and are very likely within the range of experimental error. However, the addition of an extension barrel significantly improves weft arrival times for the particular contoured nozzle of this test when operated at low supply pressures, this nozzle having poor efficiency at such low pressures, the difference in barrel lengths having relatively small significance. At higher operating pressures, on the other hand, the unmodified contoured nozzle, i.e. without an extension barrel, operates nearly as efficiently as the extended contoured nozzles. It will be seen that the head pressures achieved by this group of nozzles come close to the corresponding supply pressures; thus, essentially all of the energy of the supply pressure was effectively delivered directly to the nozzle with little measureable impedance indicating the occurrence of choking at the nozzle throats irrespective of the absence or presence of an extension barrel.

(2) "Straight" Nozzle

In addition to supersonically contoured nozzles, there have also been tested for purposes of this invention nozzles which instead of being contoured divergently downstream of the convergent throat area, extend cylindrically, i.e. with uniform diameter, to the plane of the exit opening to the ambient atmosphere. Such nozzles are referred to here as "straight" to distinguish them from supersonically contoured nozzles and when choked have only a maximum flow velocity at the nozzle throat of Mach No. 1.0, although upon leaving the exit opening, the air flow is sufficiently pressurized may expand into the atmosphere and hence may reach supersonic velocity in a region adjacent the nozzle exit. The air delivery path for the straight nozzle is identical to that of the contoured nozzles, (i.e. as shown in FIG. 3), the only change being the replacement of an end insert section of the nozzle to give the different shape and/or size. Since a straight nozzle already incorporates a short extension barrel equal to about 5×D, extending downstream of the throat, comparative tests with additional extension barrels were not carried out for straight nozzles, but instead tests were performed with straight nozzles of varying throat area to illustrate the effect of increasing throat area on nozzle performance, which effect would be expected to be substantially the same for both contoured and straight nozzles. The straight nozzles tested included one of 11 mm$^2$ cross-sectional throat area with a throat exit diameter of 0.175" (for direct comparison with the unmodified contoured nozzle of Table I) plus two others with throat cross-sectional areas of 16 and 32 mm$^2$, respectively, corresponding to throat exit diameters of 0.2015" and 0.268". The same feed tube associated with the contoured nozzle test was used here with its free end projecting just past the exit plane of the nozzle and with the weft introduced with a 1" projecting length beyond the feed tube end as before.

Figure 14:
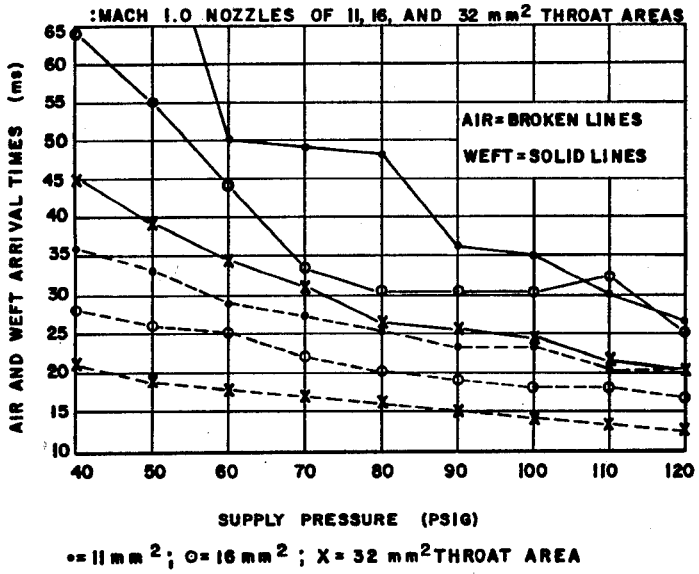
FIG. 14 is a graph similar to FIG. 13 for three uncontoured nozzles having throat areas of 11, 16 and 32 $mm^2$, respectively, without extension barrels.

The results of the tests of these straight nozzles appear in Table II and have been plotted in FIG. 14, the several sized nozzles being identified by captions.

TABLE II

| | Effect of Throat Size Variations with Straight Nozzle | | | | | | | | |
|---|---|---|---|---|---|---|---|---|---|
| | Air Arrival Time (ms) Throat Area (mm$^2$) | | | Weft Arrival Time (ms) Throat Area (mm$^2$) | | | Head Pressure (psig) Throat Area (mm$^2$) | | |
| Supply Pressure | 11 | 16 | 32 | 11 | 16 | 32 | 11 | 16 | 32 |
| 40 | 36 | 28 | 21 | NA | 64 | 45 | NA | 39 | 39 |
| 50 | 33 | 26 | 19 | 98 | 55 | 39 | 48 | 48 | 45 |
| 60 | 29 | 25 | 18 | 50 | 44 | 35 | 57 | 57 | 50 |
| 70 | 27 | 22 | 17 | 49 | 33 | 31 | 70 | 67 | 60 |
| 80 | 25 | 20 | 16 | 48 | 30 | 26 | 78 | 78 | 70 |
| 90 | 23 | 19 | 15 | 36 | 30 | 25 | 87 | 87 | 76 |
| 100 | 23 | 18 | 14 | 35 | 30 | 24 | 97 | 96 | 87 |
| 110 | 20 | 18 | 13 | 30 | 32 | 21 | 110 | 108 | 99 |
| 120 | 20 | 17 | 12 | 26 | 25 | 20 | 120 | 118 | 108 |

From these results, one concludes that air arrival times as well as weft arrival times are generally improved, i.e., lower, by increasing the cross-sectional area of the nozzle throat. Here again, the efficiency of the 11 mm$^2$ nozzle, similar to the contoured nozzle of Table I, is substantially better at higher than lower operating pressures, and such behavior is seen to some extent for the 16 mm$^2$ nozzle. That is, while all of the tested nozzles exhibit a potential or capacity for highly accelerated weft delivery times, as shown by their air delivery times, that potential may in fact be realized only when their driving pressure has been adjusted to a sufficiently high level since it is at these higher pressures that the weft delivery times exhibit a pattern which begins to track or parallel the pattern of the air arrival times. For this reason, it is preferred in actual practice that the supply pressure for a given weft and nozzle be adjusted as necessary to produce weft arrival times which change as a function of pressure at the same rate as the air arrival times, i.e. that the supply pressure be within the region where the weft and air arrival times are substantially parallel and optimum performance is actually realized.

d. Nozzle Supply Capacity Variations

Figure 25A:
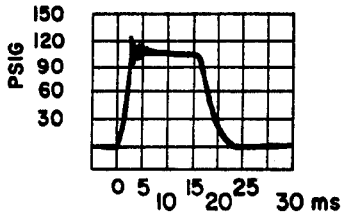
Figure 25B:
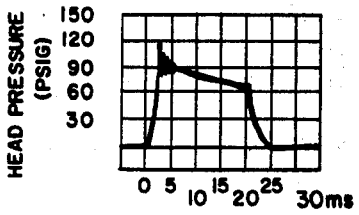
FIG. 25B is a recreation of a pressure trace for the identical system absent any added supply capacity or accumulator and illustrating the change in time in peak pulse pressure at the lower supply capacity compared with the pulse of FIG. 25A.

In all of the tests of Tables I and II above, the pressure source for all nozzles tested included a supplemental supply reservoir or accumulator designated 137 in FIG. 1 having a volume of 80 in$^3$ in addition to the 6 in$^3$ capacity of the nozzle supply chamber itself, this accumulator being connected to the nozzle supply chamber inlet opening through a ⅜" I.D. line of not more than 12" length and in turn connected to a line pressure main having the indicated supply pressure. To illustrate the difference this added supply capacity makes on nozzle performance, oscilloscopically derived head pressure traces were recorded using the contoured nozzle of Table I having the 5×D barrel at a supply pressure of 100 psig with the supplemental reservoir connected and disconnected, respectively, and these head pressure traces are shown side by side in FIGS. 25A and 25B wherein each horizontal unit represents a time interval of 5 or 10 secs. and each vertical unit pressure change of 30 psig. Both traces confirm the almost instantaneous response time of the preferred nozzle design of the invention, that is, the pressure rises from zero to a maximum near in both cases to the 100 psig supply pressure in less than 2 ms, and actually exceeds that pressure very briefly before the pressure wave oscillations stabilize or dampen out after a few more milliseconds. It can be seen, however, that with only the nozzle supply chamber capacity itself available, the head pressure after reaching maximum gradually decreases until at the end of the approximately 15 ms nozzle activation period, the head pressure in the nozzle of the small capacity (6 in$^3$) has dropped to approximately 70–75 psig. In contrast, with the supply capacity augmented to a full 86 in$^3$, as preferred, the pressure trace exhibits a virtual flat plateau maintaining full head pressure over the entire activation interval of the nozzle and drops only after flow of air to the nozzle has been positively terminated.

Data showing the effect of the difference in air supply capacity on air and weft delivery capabilities of the nozzle is summarized in Table III below from which one learns that the high capacity gives significantly improved efficiency at lower pressures and slight improvement at higher pressures. The data of Table III appears graphically in FIG. 18 (consolidated with curves illustrating the effect of another variable, i.e. the Mach number in contoured nozzles which will be discussed later).

TABLE III

| | | Effect on Weft Arrival Times (ms) of Variation in Supply Capacity | | | | | | | | | |
|---|---|---|---|---|---|---|---|---|---|---|---|
| | | Supply Pressure | | | | | | | | | |
| Nozzle Type | Mach No. | 30 | 40 | 50 | 60 | 70 | 80 | 90 | 100 | 110 | 120 |
| A. Large Capacity (86 in.$^3$) | | | | | | | | | | | |

TABLE III-continued

| Nozzle Type | Mach No. | Effect on Weft Arrival Times (ms) of Variation in Supply Capacity — Supply Pressure 30 | 40 | 50 | 60 | 70 | 80 | 90 | 100 | 110 | 120 |
|---|---|---|---|---|---|---|---|---|---|---|---|
| Con No Bbl | 1.5 | 68 | 63 | 59 | 50 | 39 | 35 | 35 | 33 | 28 | 25 |
| B Small Capacitv (6 in.$^3$) | | | | | | | | | | | |
| Con 5 × D Bbl | 1.5 | — | 75 | 75 | 52 | 38 | 32 | 28 | 28 | 28 | 26 |

In the pressure traces for both the small and large capacity nozzles, after completion of the "rise time", the supply pressure remains well above ambient pressure over the entire pulse interval, and a distinct inflexion or break appears in each trace only when the control valve is positively moved to closed position to cut off the air flow, the head pressure then decreasing fairly rapidly to ambient. This behavior indicates that the supply capacity volume, even when only 6 in$^3$, is very substantially in excess of the rate of flow that can pass through the nozzle throat at the given pressure over the pulse interval and that the supply capability of the supply chamber is in fact delivered to the nozzle throat at a rate greater than the nozzle flow rate.

The "fall time" of each pressure trace tends to be somewhat longer than the "rise time" due to the need of residual air in the delivery passages between the nozzle diaphragm valve and throat to dissipate but the bulk of the pressure drop occurs almost instantaneously and the remainder has no perceived effect on nozzle performance. As previously stated, any clamping of the weft must occur only after substantial decay of the trace to avoid disintegration of the weft.

e. Air Pulse Width Variation

The results comparing high and low air supply capacities were, as stated, obtained with an approximate 15 ms nozzle activation interval, as were the results of Tables I and II, and the option exists of altering this interval to change the duration of the air pulse emitted by the nozzle. The effect of such alteration for both large and small capacity nozzles is set forth in Table IV for the 11 mm$^2$ area contoured nozzle of Table I supplied with a pressure of 80 psig.

TABLE IV

| | Effect of Variation in Air Pulse Width — Pulse Width (ms) 5 | 8 | 10 | 15 | 20 | 25 | 30 | 35 | 40 |
|---|---|---|---|---|---|---|---|---|---|
| A. Large Capacity | | | | | | | | | |
| Air Arrival (ms) | NA | 28 | 25 | 23 | 23 | 23 | 23 | 23 | 23 |
| Weft Arrival (ms) | NA | NA | 55 | 33 (28) | 28 | 26 | 26 | 26 | 26 |
| Integrated Pressure Units | — | — | — | 1179 | — | — | — | — | — |
| B. Small Capacity | | | | | | | | | |
| Weft Arrival (ms) | — | — | — | 39 | 31 | 29 | 30 | — | — |
| Integrated Pressure Units | — | — | — | 970 | 1102 | 1473 | 1560 | — | — |

Figure 13:
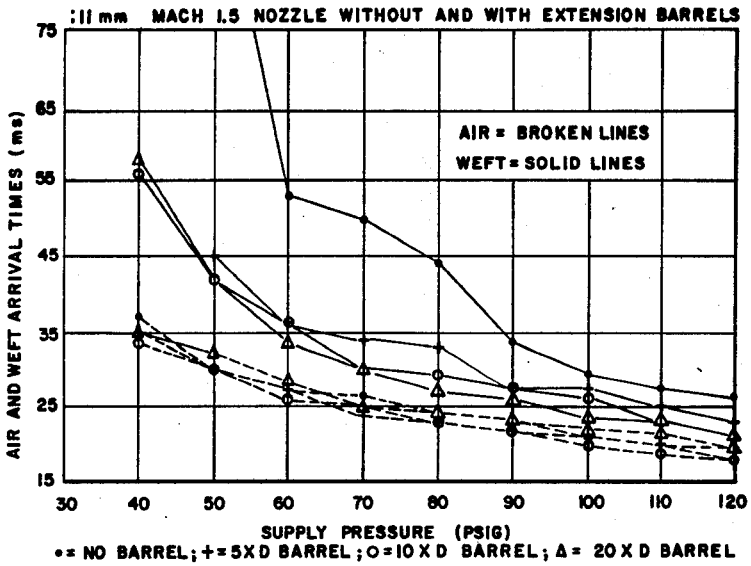
FIG. 13 is a graph plotting air and weft arrival times against supply pressure over a range of 40–120 psig for and 11 $mm^2$ supersonically contoured nozzle with and without extension barrels of lengths equal to 5, 10 and 20 times the diameter of the nozzle outlet.

Below the 10 ms level, the nozzle was incapable of projecting the yarn across the full 52" distance at all, as indicated by the letters "NA" (no arrival), but significant improvement was obtained with this nozzle at higher operating pressures, as was true in Table I and FIG. 13. In the test utilizing only a small capacity (6 in$^3$) unit, only weft arrival times were recorded at several pulse width intervals.

Based on this data, for the nozzles in question, the air pulse width or duration should be at least about 10 ms and preferably within the range of about 15–35 ms at the preferred pressure range of about 60–80 psig, dependent upon air supply capacity and other considerations.

To provide an alternative basis of evaluation, the areas under the pressure traces for the pulse obtained with the small capacity (6 in$^3$) air supply plus one large capacity pulse for comparison were integrated to give a value representing the total quantity of "pressure units" expended during the entire air pulse, and these values are stated in Table IV as "integrated pressure units". The weft arrival time for the large capacity nozzle varied somewhat from an earlier value, the latter being indicated in parentheses. It will be seen from these values that the large supply capacity (86 in$^3$) nozzle can achieve roughly equal arrival times as a small capacity nozzle consuming about 30–40% more pressure energy, as measured in integrated pressure units.

f. Comparative Prior Art Simulation

To afford a basis for evaluating performance of the system of the invention against the performance typically achieved by prior art air weft insertion systems, a simulation of a typical prior art system was devised as shown schematically in FIG. 15. To eliminate the influence on performance of nozzle design, the nozzle of the simulation was actually a version of the nozzle of the invention, as depicted in FIG. 3, with the actuating diaphragm removed and the 6 in$^3$ supply capacity volume blocked out with an impermeable filler, e.g. wax, so that air admitted to the end opening of the nozzle fed directly into the annular passage 115 in the nozzle head and thence to the delivery passageway of the nozzle. The nozzle inlet was connected by three feet of an air conduit of ⅜" O.D. and about ¼" I.D. to the outlet of a ¼" cam operated poppet diaphragm valve. The inlet side of this valve was in turn connected by 12" of the same tubing to a pressure regulated capacitor. The poppet valve was actuated by means of an air motor rotated at approximately 400 rpm, the configuration of the cam being such that the poppet valve was displaced to open position for an interval of 55–60 ms.

In order to allow the air motor driven poppet control valve to be brought up to operating speed before delivery of the air thereto, the air supply capacitor actually took the form of one of the nozzles of the invention including the supplemental reservoir (total capacity 86"$^3$), the outlet of the nozzle being connected to the inlet of the poppet valve as stated. In this way, instantaneous delivery of the air to the already working poppet valve could be readily accomplished, the supply nozzle valve being maintained in open position throughout the full operating interval of the poppet valve. The pressure delivered by this supply nozzle was adjusted to provide the desired effective supply pressure to the poppet valve. All other conditions were the same as in the tests of Tables I and II, and air arrival times, weft arrival times, as well as pressure traces, were derived and recorded as before.

Figure 16:
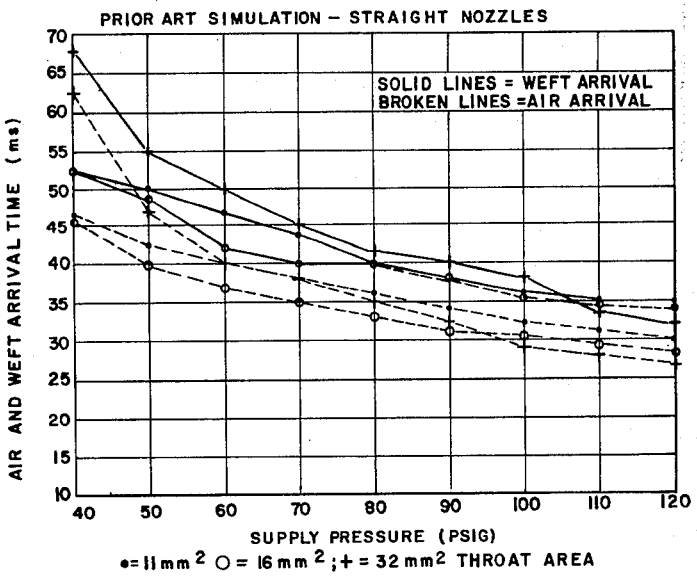
FIG. 16 is a comparative graph similar to FIG. 14 but representing the performance of a simulation of a prior art air weft insertion system using uncontoured nozzles of varying throat areas.
Figure 17:
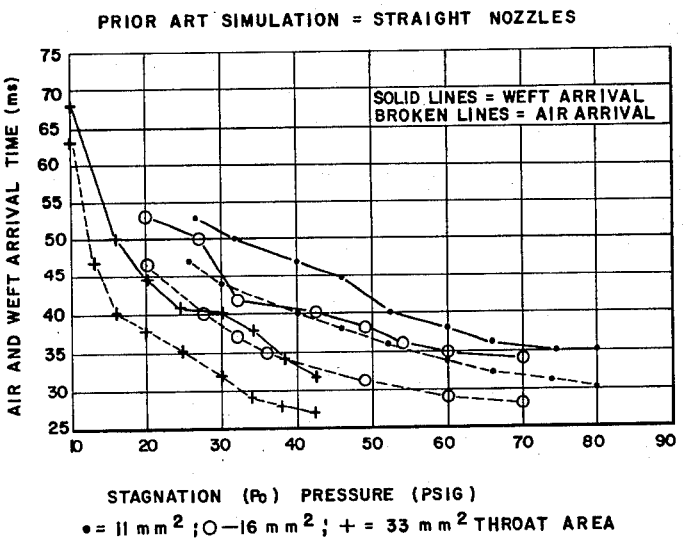
FIG. 17 is a comparative graph plotting air and weft arrival times versus actual nozzle stagnation or head pressure achieved by the prior art simulation of FIG. 15 with the same nozzles as in the graph of FIG. 16.
Figure 19A:
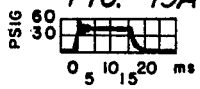
FIGS. 19A-I represent reproductions of actual oscillographically derived pressure traces showing the changes in head pressure versus time in air pulses generated by the 11 $mm^2$ throat area uncontoured nozzle of FIG. 14 when operated at 10 psi intervals over the range of supply pressures of 40–120 psig.
Figure 19B:
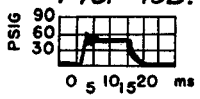
Figure 19C:
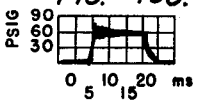
Figure 19D:
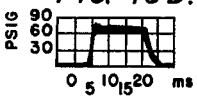
Figure 19E:
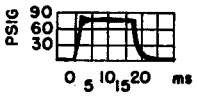
Figure 19F:
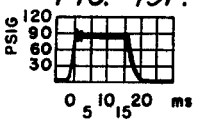
Figure 19G:
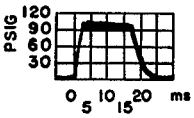
Figure 19H:
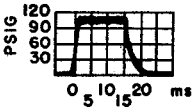
Figure 19I:
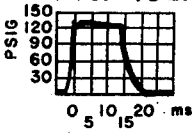
Figure 20A:
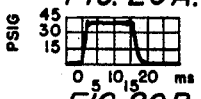
FIGS. 20A-I are reproductions of pressure traces similar to FIGS. 19A-I but for a 16 $mm^2$ throat area uncontoured nozzle and on a different scale.
Figure 20B:
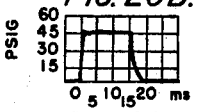
Figure 20C:
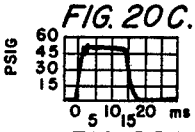
Figure 20D:
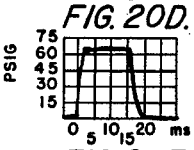
Figure 20E:
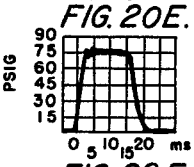
Figure 20F:
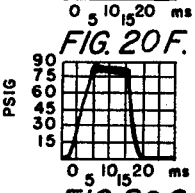
Figure 20G:
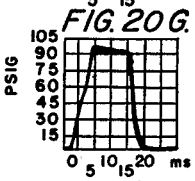
Figure 20H:
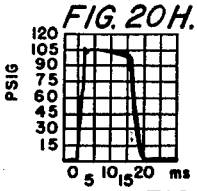
Figure 20I:
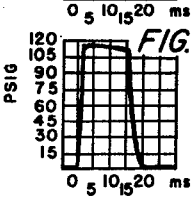
Figure 21A:
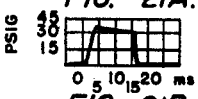
FIGS. 21A-I are recreations of pressure traces similar to FIGS. 19A-I and 20A-I but for the 32 $mm^2$ throat area uncontoured nozzle and on the same scale as FIG. 20A.
Figure 21B:
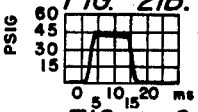
Figure 21C:
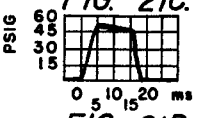
Figure 21D:
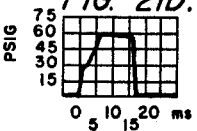
Figure 21E:
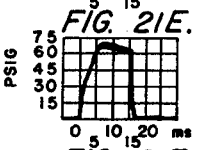
Figure 21F:
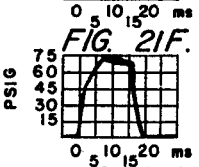
Figure 21G:
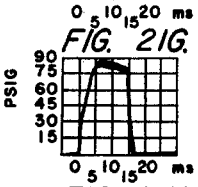
Figure 21H:
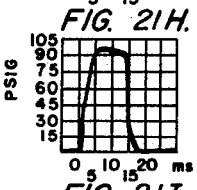
Figure 21I:
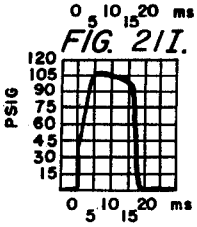
Figure 22A:
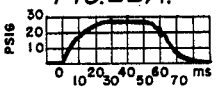
FIGS. 22A-I are comparative recreations of pressure traces similar to FIGS. 19A-I but on a different scale for the prior art simulation of FIGS. 15 and 16 utilizing an 11 $mm^2$ throat area uncontoured nozzle.
Figure 22B:
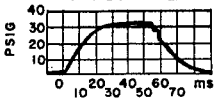
Figure 22C:
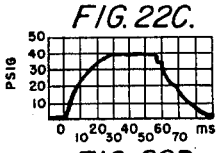
Figure 22D:
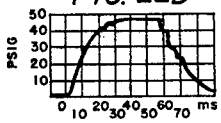
Figure 22E:
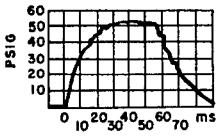
Figure 22F:
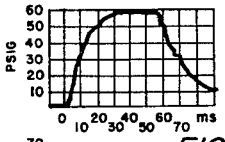
Figure 22G:
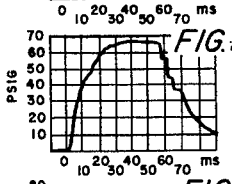
Figure 22H:
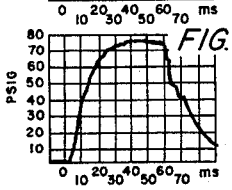
Figure 22I:
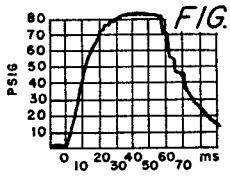
Figure 23A:
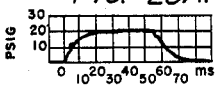
FIGS. 23A-I are comparative recreations of pressure traces similar to FIGS. 20A-I but on a different scale for the prior simulation with a 16 $mm^2$ throat area uncontoured nozzle.
Figure 23B:
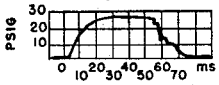
Figure 23C:
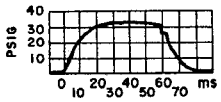
Figure 23D:
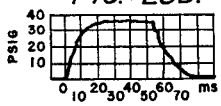
Figure 23E:
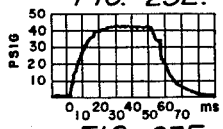
Figure 23F:
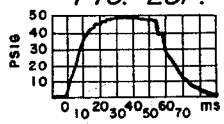
Figure 23G:
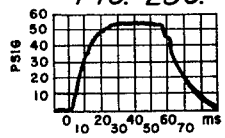
Figure 23H:
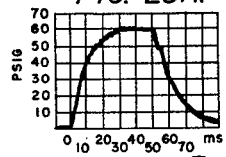
Figure 23I:
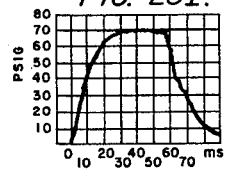
Figure 24A:
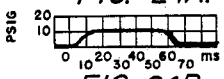
FIGS. 24A-I are comparative recreations of pressure traces similar to FIGS. 21A-I but on a different scale for the prior art simulation with a 32 $mm^2$ throat area uncontoured nozzle.
Figure 24B:
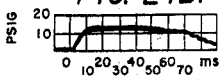
Figure 24C:
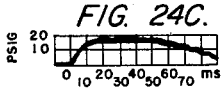
Figure 24D:
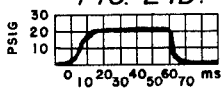
Figure 24E:
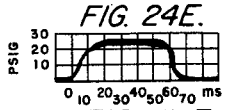
Figure 24F:
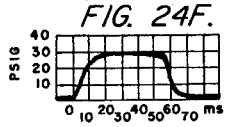
Figure 24G:
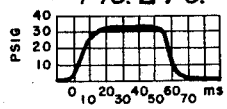
Figure 24H:
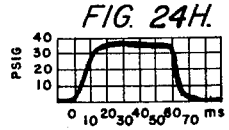
Figure 24I:
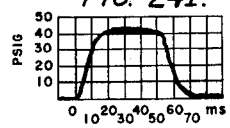

The nozzles employed in the prior art simulation were the straight nozzles of Table II, having the same varying areas of 11, 16 and 32 mm$^2$, respectively, without any additional extension barrel. The duration of the air pulse was 55–60 ms. The results of these tests are summarized in Table V below and are plotted graphically in FIGS. 16 and 17 which plot air and weft arrival times versus supply pressure and nozzle head or stagnation pressure, respectively.

TABLE V

Results of Prior Art Simulation with Straight Nozzles of Varying Throat Area

| | Air Arrival Time (ms) Throat Area (mm$^2$) | | | Weft Arrival Time (ms) Throat area (mm$^2$) | | | Head Pressure (psig) Throat Area (mm$^2$) | | |
|---|---|---|---|---|---|---|---|---|---|
| Supply Pressure | 11 | 16 | 32 | 11 | 16 | 32 | 11 | 16 | 32 |
| 40 | 47 | 46 | 63 | 53 | 53 | 68 | 26 | 20 | 10 |
| 50 | 43 | 40 | 47 | 50 | 50 | 55 | 32 | 27 | 13 |
| 60 | 40 | 37 | 40 | 47 | 42 | 50 | 40 | 32 | 16 |
| 70 | 38 | 35 | 38 | 44 | 40 | 45 | 46 | 36 | 20 |
| 80 | 36 | 33 | 35 | 40 | 40 | 41 | 52 | 42 | 25 |
| 90 | 34 | 31 | 32 | 38 | 38 | 40 | 60 | 49 | 30 |
| 100 | 32 | 30 | 29 | 36 | 36 | 38 | 66 | 54 | 34 |
| 110 | 31 | 29 | 28 | 35 | 35 | 34 | 74 | 60 | 38 |
| 120 | 30 | 28 | 27 | 35 | 34 | 32 | 80+ | 70 | 42 |

From this data, one learns that the air arrival values for the prior art simulation are substantially independent of variations in the throat area (apart from the 32 mm$^2$ area nozzle at pressures below about 50 psig, which gave even worse values) but in all cases are substantially slower than the air arrival times achieved by the invention. Inasmuch as the air arrival time constitutes a limiting factor on performance, in the sense that the weft arrival times can never exceed the air arrival times so that the most one can hope for is to achieve weft arrival times as close as possible but always somewhat less than the air arrival times, it follows that the weft arrival times achieved in the prior art simulation are inherently inferior to those possible with the system of the invention and are never in fact as short as the desired goal of 30 ms, even with a large area nozzle and very high supply pressures. At low supply pressures, the weft arrival times achieved with the small area nozzles in the prior art system may sometimes be shorter than those achieved with comparable nozzles in the system of the invention, but this apparent advantage is more than offset by the greater duration of the pulse interval in the prior art simulation exceeding by four times the pulse interval of the inventive system, with a consequential greatly multiplied consumption of air. Thus, compared on the basis of actual energy consumed, the system of the invention exhibits significantly greater overall efficiency. In addition, the system of the invention has the potential for greatly improved efficiency by increasing supply pressure which is inherently lacking in the systems operated in the manner of the prior art.

The "pressure signatures" recorded for the various tests in the prior art simulation are duplicated in FIGS. 22A-I, 25A-I, and 24A-I for 11 mm$^2$, 16 mm$^2$, and 32 mm$^2$ throat areas respectively, covering at 10 psi intervals the entire supply pressure range of 40–120 psig and comparable "pressure signatures" for the same 11 mm$^2$, 16 mm$^2$, and 32 mm$^2$ area nozzles operated according to the invention in the tests of Table II appear (with scale changes for convenience as indicated) in FIGS. 19A-I, 20A-I, and 21A-I, respectively, at the same pressures. Analysis of these pressure signatures shows that for the invention, the instantaneous achievement of maximum nozzle pressure occurs essentially independently of supply pressure, i.e., is virtually identical throughout the entire pressure range, and is only moderately affected by increases in nozzle throat area. Even for a large throat area nozzle, i.e., 32 mm$^2$, the time for the head pressure to rise from zero to maximum, i.e., "rise time", rarely exceeds 5 ms, in a majority of instances is not more than 3 ms, and frequently is only 1 ms. Similarly, the "plateau effect" discussed previously, wherein the maximum head pressure persists substantially at full maximum level throughout the entire interval of the pulse, is characteristic of all of the pressure traces representing the invention system. Even for the maximum throat area nozzle, the loss in pressure from beginning to end of the pulse is in the order of approximately 5% and never goes as high as 10%. The maximum pressure trace levels representing operating head pressures for the invention closely approximate the supply pressure levels. From these relationships, one concludes that the nozzles of the invention are thus delivering pressure energy to the yarn at the highest possible efficiency and are in choked condition.

Furthermore, the portion of the pulse in the invention during which the maximum pressure is at least substantially maintained always substantially exceeds, i.e., by a factor of at least two, the rise time. This means that the pulse is predominantly devoted to useful work with minimum loss in "starting up".

In contrast, the head pressure traces obtained during the prior art simulation exhibit radically different characteristics. In the first place, the "rise time" even for the very small throat area nozzles is in all instances at least, and usually greater than, 20–25 ms and does not become substantially shorter with increasing or decreasing nozzle throat area. That is to say, the slow rise time of the prior art simulation is inherent in the air supply thereof and is not improved by varying the nozzle area. Collaterally with the prolonged rise time, the pressure wave form of the prior art system does not after its initial peak show a temporary oscillation or "hunting" which tends to denote a fully loaded choked condition.

In the second place, even though each nozzle in the prior art simulation maintains maximum head pressure for a significant proportion of the pulse interval and until the poppet valve begins to close upon release of its operating cam, thereby indicating an ample supply capacity of air during the simulation, the actual head or stagnation pressure level occurring within each of the nozzles during the prior art simulation is at most in the order of about 60–70% of the supply pressure levels and is significantly less than the percentages achieved in the invention. Moreover, the difference between head and supply pressures increases dramatically with increasing throat area so that for nozzles with the largest throat area, maximum head pressure is in the order of only 25–30% of supply pressure. From these characteristics, one must conclude that the nozzles in the prior art simulation are in no case choked in the sense of the invention, notwithstanding their operation at supply pressures over the same range.

In the simulation pulses, almost as much, and sometimes more, time is consumed in reaching working pressures, i.e. "starting up", as in maintaining working pressure which imposes a definite obstacle to high operating speeds and efficiency.

g. Other Variable Conditions in the Invention (1) Nozzle Mach No.

Another factor susceptible to change in the practice of this invention is the Mach number of the supersonically contoured nozzle and to explore the influence of this variable on weft delivery efficiency, a series of tests was performed using supersonically contoured nozzles having an identical throat area of 11 $mm^2$ with increasing exit opening diameters (i.e. 0.186", 0.207" and 0.220") as necessary to provide design Mach numbers of 1.5, 1.91 and 2.07, respectively. These nozzles were tested for weft arrival times only both with and without a 5×D barrel at supply pressures in the range of 30–120 psig, and the data produced in the tests are summarized in Table VIII and are plotted in FIG. 18. From this data one see that change in Mach number has little or no practical influence on the effectiveness of the nozzle in propelling the weft, although the addition of a barrel does afford some improvement at lower supply pressures.

TABLE VIII

Effect on Weft Arrival Times (ms) of Variation in Contoured Nozzle Mach Number

| | | Weft Arrival Time (ms) Supply Pressure | | | | | | | | | |
|---|---|---|---|---|---|---|---|---|---|---|---|
| Nozzle Type | Mach No | 30 | 40 | 50 | 60 | 70 | 80 | 90 | 100 | 110 | 120 |
| Con No Bbl | 1.5 | 68 | 63 | 59 | 50 | 39 | 35 | 35 | 33 | 28 | 25 |
| Con No Bbl | 1.91 | NA | 70 | 62 | 54 | 36 | 35 | 33 | 31 | 31 | 27 |
| Con No Bbl | 2.09 | NA | NA | 72 | 45 | 40 | 34 | 33 | 31 | 29 | 29 |
| Con 5 × D Bbl | 1.5 | 68 | 58 | 39 | 33 | 30 | 30 | 30 | 28 | 26 | 24 |
| Con 5 × D Bbl | 1.91 | NA | NA | 53 | 41 | 30 | 25 | 26 | 26 | 24 | 21 |
| Con 5 × D Bbl | 2.09 | NA | 64 | 43 | 35 | 33 | 33 | 29 | 24 | 23 | 21 |

Figure 18:
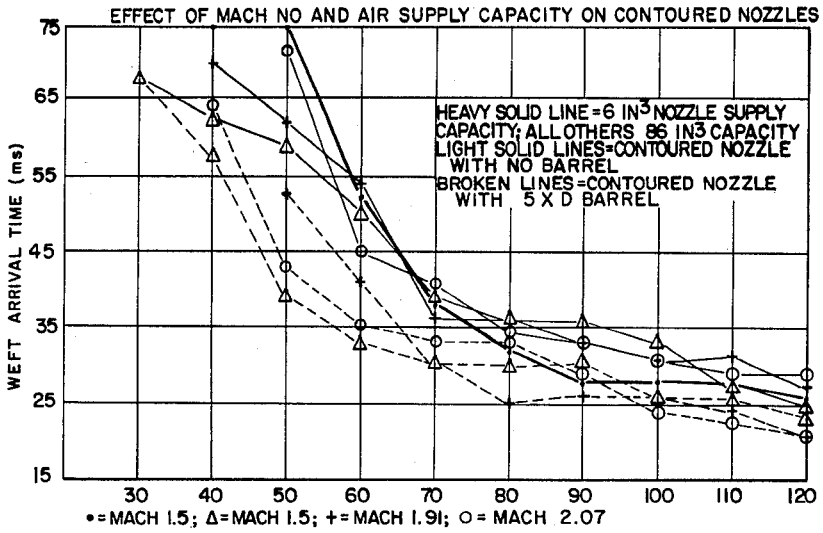
FIG. 18 is a plot similar to FIGS. 13 and 14 of the system of the invention comparing the weft arrival times over a range of supply pressures of 30–120 psig for supersonically contoured nozzles ranging from Mach 1.5 to Mach 2.07, with and without an extension barrel equal in length to five times the nozzle outlet diameter, supplied with air from a large capacity accumulator, with the Mach 1.5 nozzle being also operated with a low capacity accumulator for comparative purposes.

All of the tests in Table VIII included the large (86"$^3$) supply capacity for the various nozzles, and it will be recalled that FIG. 18 includes a curve representing a test of a Mach 1.5 nozzle with a 5×D barrel identical to the corresponding nozzle of Table VIII, but having a small capacity (6"$^3$) air supply. Comparing these results, one sees the considerable extent of improvement afforded by the addition of the large capacity supply which is particularly prominent at lower pressures, i.e. below about 90 psig.

(2) Projected Energy Consumption

The importance of a capability for effective operation at the lower range of supply pressures which characterizes the invention is illustrated by the following Table IX which shows a projected consumption of energy, expressed in kilowatts per minute, for a loom equipped with the system of the invention and operating at 1000 picks per minute for nozzles having throat areas of 11 $mm^2$ and 16 $mm^2$, either supersonically contoured or straight, with a pulse duration of 15 ms and a large (86"$^3$) capacity supply.

TABLE IX

Projected Energy Consumption (kilowatts)

| | Supply Pressure (psig) | | | | | | | | |
|---|---|---|---|---|---|---|---|---|---|
| | 40 | 50 | 60 | 70 | 80 | 90 | 100 | 110 | 120 |
| 11 $mm^2$ Nozzle Area | .323 | .447 | .579 | .721 | .873 | 1.03 | 1.203 | 1.378 | 1.56 |
| 16 $mm^2$ Nozzle Area | .473 | .649 | .839 | 1.04 | 1.26 | 1.50 | 1.73 | 1.99 | 2.26 |

Thus, the increase in power consumption is not a linear function of either increasing head pressure or nozzle throat area but an exponential function, the energy consumption at 90 psi supply pressure, for example, being more than three times the consumption at 40 psi.

In this description, the abbreviations ms represents milliseconds and psig represents pounds per square inch gauge.

What is claimed is:

1. An intermittently-operating strand delivery system comprising;

(1) a nozzle passageway through which the strand is guided;

(2) a supply for pressurized medium;

(3) conduit means connecting between said nozzle passageway and said supply including a pressure-operated on-off flow valve, and (4) separate servo means for independently applying and releasing control pressure respectively to and from said pressure-operated flow valve to move the same alternately between open and closed position to permit the medium to flow from said supply through said nozzle passageway for a controlled interval to emit a pulse of said medium from said nozzle passageway and project a length of said weft strand therefrom.

2. The system of claim 1 including hollow strand guide means projecting into said passageway for presenting a leading end portion of said weft strand to said passageway.

3. The system of claim 2 wherein said passageway converges to a locus of minimum cross-sectional area and said hollow guide means extends to said locus.

4. The system of claim 1 wherein said valve means includes a diaphragm deformable between a first operative position with one of its sides closing said conduit means and a second inoperative position with one side withdrawn from said conduit means to open the latter in response to the application and release of control pressure to and from the opposite diaphragm side.

5. The system of claim 4 wherein the area of the opposite diaphragm side to which said control pressure is applied is at least equal to the area of the first side diaphragm exposed to the pressurized medium in said supply conduit means.

6. The system of claim 4 wherein said supply is a chamber having an annular discharge opening which is closed when said diaphragm is in said first operative position and said conduit means extends laterally from one annular side of said opening for communication therewith when said diaphragm deforms to its second inoperative position, whereby the deforming action of the diaphragm is accelerated by the increasing area of said one side thereof to the pressure in said supply chamber.

7. The system of claim 4 including a second diaphragm spaced from said first diaphragm and a floating mechanical element between said diaphragms to enhance the action against the first diaphragm of pressure applied to the second diaphragm.

8. The system of claim 7 wherein said element is a rigid ring having a thickness substantially equal to the space between said diaphragms and a greater annular area on the side thereof adjacent said second diaphragm than the annular area of the side adjacent the first diaphragm.

9. The system of claim 8 including means for restraining said rigid ring against substantial lateral movement with said space.

10. The system of claim 4 including a source of control pressure and conduit means connecting said source to said opposite diaphragm side, said diaphragm isolating said medium supply from said control pressure source.

11. The system of claim 1 including means for delivering a flow of pressurized medium directly to said passageway to facilitate entry of said strand therein.

12. The system of claim 1 wherein said separate servo means are independently adjustable relative to one another.

13. The system of claim 12 wherein each servo means is a rotary spool valve connecting to a source of control pressure.

14. The system of claim 13 wherein each said rotary spool valve comprises a rotary spool having a supply passage at one locus on its periphery and an exhaust passage at a separate locus on its periphery; and a housing for said spool having at peripherally spaced locations therearound a supply port connected to a pressure source, a delivery port communicating with said pressure-operated valve and an exhaust port opening to the atmosphere, whereby rotation of said spool selectively places said delivery port in communication with said supply port and delivery port, respectively.

15. The system of claim 14 wherein each of said supply passage and said exhaust passage are formed by separate recesses in the periphery of said spool of predetermined arcuate extent, said recesses being peripherally displaced from one another and substantially sealed against cross flow therebetween.

16. The system of claim 15 including counterbalancing recesses of equal peripheral extent and area disposed in diametrical opposition to each of said supply and exhaust recesses and said delivery and exhaust passages including diametrically opposite extensions for communicating with the corresponding counterbalancing recesses to counteract radial pressure loads acting on each said spool.

17. The system of claim 14 wherein said housing defines a cylindrical chamber into which said spool fits, said spool having end sections and at least one arcuate land region in its periphery between said end sections of a diameter making a sealing fit with said chamber, with the remainder of its periphery being of lesser diameter to form a clearance with said chamber, means for supplying pressure to said clearance between said spool and chamber, a delivery port in said housing communicating with said chamber at a locus on the spool periphery corresponding to the path of said land region during spool rotation, said land region having an exhaust aperture in the interior thereof isolated from said clearance and opening to the atmosphere to exhaust said delivery port when said aperture registers with said delivery port during rotation of said spool, the pressure in said clearance space being transmitted to said delivery port when the lesser diameter spool periphery conjugal to said land region registers with said delivery port.

18. The system of claim 17 wherein said exhaust aperture occupies only a minor part of the arcuate extent of said land region whereby said delivery port can be closed by the solid remainder of said land region.

19. The system of claim 13 wherein said supply passage and exhaust passage are spaced apart axially of said spool and said delivery port includes an extension axially aligned with said exhaust passage to communicate therewith.

20. The system of claim 12 wherein each said servo means is a solenoid-operated valve connecting to a source of control pressure.

21. The system of claim 20 wherein each said solenoid operated servo valve has a supply position for placing said source of control pressure in communication with said pressure-operated valve and an exhaust position for placing said pressure-operated valve in communication with the atmosphere and including means for preventing pressure applied to the pressure-operated valve from being exhausted when either servo-valve is in supply position.

22. The system of claim 21 wherein said solenoid-operated valves communicate with said pressure-operated valve through a common conduit and including pressure-responsive selector means in said common conduit for permitting communication with only one solenoid-operated valve at a time.

23. The system of claim 1 wherein said pressurized medium is a gaseous medium.

24. The system of claim 23 wherein said supply comprises a chamber arranged coaxially with said passageway and containing said pressurized gaseous medium.

25. The system of claim 24 wherein said supply chamber is arranged in coaxial surrounding relation to at least an end portion of said passageway and said conduit means connects between corresponding ends of said passageway and chamber.

26. A method of intermittently delivery a strand comprising the steps of:

(1) guiding the leading end of the strand into a nozzle passageway;

(2) connecting said passageway to a source of pressurized medium through a pressure-operated flow valve which is closed by a positive control pressure and opened by the release of such pressure;

(3) connecting said pressure-operated flow valve to a source of control pressure through a pair of separate servo valves moving between delivery and exhaust positions; and (4) independently actuating one of said servo valves to apply said control pressure to said pressure-operated valve and the other of said valves to release said control pressure from said pressure-operated valve.

27. The method of claim 26 including the step of controlling the actuation of said servo valves in an adjustable predetermined sequence.

28. An intermittently operable strand delivery system comprising:

(1) a nozzle passageway through which the strand is guided, said passageway converging to a minimum cross-sectional area;

(2) a supply of a pressurized medium maintained at a pressure having a ratio to ambient pressure of at least about 2.7:1;

(3) conduit means for connecting said pressurized supply to said nozzle passageway including pressure-operated on-off flow valve means, said valve means comprising a valve opening in said conduit means and a diaphragm valve movable between a first operative position closing off said valve opening and a second inoperative position withdrawn from said valve opening to open the same, said conduit means including said valve opening having when said opening is open a flow rate capacity sufficient to deliver said gaseous medium to said nozzle passageway at a pressure having a ratio to ambient pressure of at least about 2.7:1; and (4) servo means for applying and releasing a control gas pressure respectively to and from said diaphragm valve to move the same between said positions to close and open said valve opening for a controlled interval, whereby when said valve is open, a pulse of said pressurized medium is emitted at supersonic velocity from said nozzle passageway to project a length of said strand therefrom.

29. The system of claim 28 wherein said valve opening is annular and is arranged generally coaxially and coterminously with the inlet end of said nozzle passageway.

30. The system of claim 29 wherein said inlet end of said nozzle passageway is annular with a radius different from the radius of said annular valve opening.

31. An intermittently operable strand delivery system comprising:

(1) a nozzle passageway through which the strand is guided, said passageway converging to a minimum cross-sectional area;

(2) a supply of a pressurized medium maintained at a pressure in excess of that required to choke said nozzle passageway and having a supply capacity substantially exceeding the flow rate of said medium through said nozzle passageway when choked;

(3) conduit means for connecting said pressurized supply to said nozzle passageway including pressure-operated on-off flow valve means, said valve means comprising a valve opening in said conduit means and a diaphragm valve deformable between a first operatibe position at which said valve opening is closed and a second inoperative position at which said valve opening is open, said conduit means including said valve opening having when said opening is open a flow rate capability sufficient to deliver said pressurized medium at a pressure in excess of choking pressure to said nozzle passageway at a flow rate exceeding the actual flow rate possible through said passageway at said pressure, whereby a choked condition of said medium is created at said minimum area of the nozzle passageway;

(4) servo means operable for applying and releasing a control gas pressure respectively to and from said diaphragm valve to move the same between said positions to close and open said valve opening;

(5) means effective when said control gas pressure is released from the diaphragm valve to urge the same to move to said inoperative position opening said valve opening within a limited time; and (6) control means for said servo means for operating the same to release said control gas pressure from said diaphragm valve for a time in excess of said limited time needed for said diaphragm valve to open before re-applying said control gas pressure thereto, whereby a pulse of said pressurized medium is emitted at supersonic velocity from said nozzle passageway for a controlled interval.

32. The system of claim 31 wherein said valve opening is annular and said diaphragm valve is subjected to said supply pressure through said annular opening and is urged by such pressure to its inoperative position.

33. The system of claim 32 wherein a larger area of said diaphragm valve is exposed to said control gas pressure upon the application of said control gas pressure thereto than is the annular area of said diaphragm valve subjected to said supply pressure.

* * * * *